US009873247B2

(12) United States Patent
Oikawa et al.

(10) Patent No.: US 9,873,247 B2
(45) Date of Patent: Jan. 23, 2018

(54) INK JET PRINTING APPARATUS AND INK JET PRINTING METHOD

(71) Applicant: CANON KABUSHIKI KAISHA, Tokyo (JP)

(72) Inventors: Yuhei Oikawa, Yokohama (JP); Taku Yokozawa, Yokohama (JP); Hiroaki Shirakawa, Kawasaki (JP); Mitsutoshi Nagamura, Tokyo (JP); Hiroshi Taira, Fuchu (JP); Satoshi Azuma, Kawasaki (JP); Yosuke Ishii, Kawasaki (JP); Hiroaki Komatsu, Fuji (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/064,421

(22) Filed: Mar. 8, 2016

(65) Prior Publication Data

US 2016/0263885 A1 Sep. 15, 2016

(30) Foreign Application Priority Data

Mar. 11, 2015 (JP) ..... 2015-048574

(51) Int. Cl.
*B41J 2/045* (2006.01)

(52) U.S. Cl.
CPC ..... *B41J 2/04573* (2013.01); *B41J 2/0458* (2013.01); *B41J 2/04553* (2013.01); *B41J 2/04563* (2013.01); *B41J 2/04588* (2013.01); *B41J 2/04591* (2013.01); *B41J 2/04593* (2013.01); *B41J 2/04598* (2013.01)

(58) Field of Classification Search
CPC ..... B41J 2/04548; B41J 2/04553; B41J 2/04563; B41J 2/04573; B41J 2/04588; B41J 2/04591; B41J 2/04593; B41J 2/04598; B41J 2/04525
See application file for complete search history.

(56) References Cited

U.S. PATENT DOCUMENTS

2003/0227497 A1* 12/2003 Tamura ..... B41J 2/0452 347/9
2009/0289980 A1* 11/2009 Tabata ..... B41J 2/04541 347/10
2013/0235104 A1* 9/2013 Ishii ..... B41J 2/04573 347/11
2013/0235106 A1* 9/2013 Katsuura ..... B41J 2/2139 347/14

FOREIGN PATENT DOCUMENTS

JP H05-31905 A 2/1993
JP 2013-184315 A 9/2013

* cited by examiner

*Primary Examiner* — Geoffrey Mruk
*Assistant Examiner* — Scott A Richmond
(74) *Attorney, Agent, or Firm* — Canon U.S.A., Inc. IP Division

(57) ABSTRACT

A driving pulse to be applied is changed when an overlapped level of invert timing of driving pulse is large.

18 Claims, 15 Drawing Sheets

FIG. 7A
| DRIVING PULSE No.[N] | DRIVING PULSE WAVEFORM |
|---|---|
| No.6 | 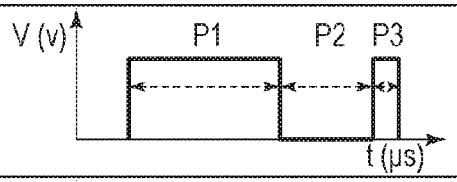  P1:0.48μs P2:0.30μs P3:0.08μs |
| No.5 | 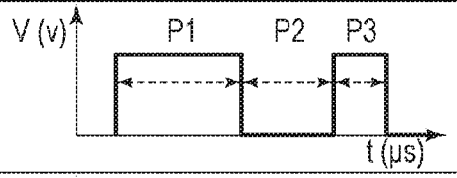  P1:0.40μs P2:0.30μs P3:0.16μs |
| No.4 | 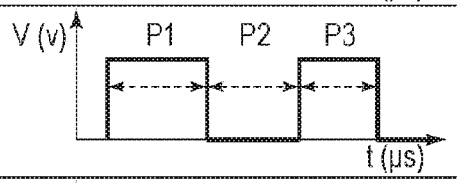  P1:0.32μs P2:0.30μs P3:0.24μs |
| No.3 | 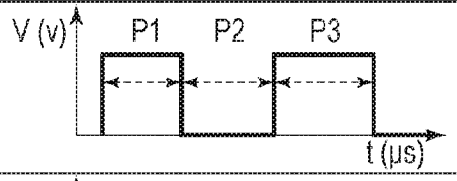  P1:0.24μs P2:0.30μs P3:0.32μs |
| No.2 | 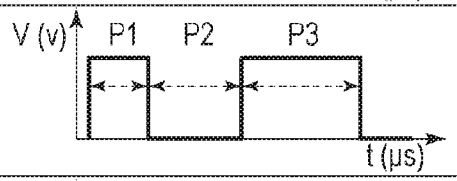  P1:0.16μs P2:0.30μs P3:0.40μs |
| No.1 | 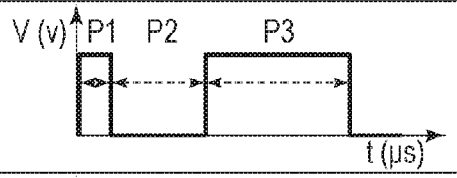  P1:0.08μs P2:0.30μs P3:0.48μs |
| No.0 | 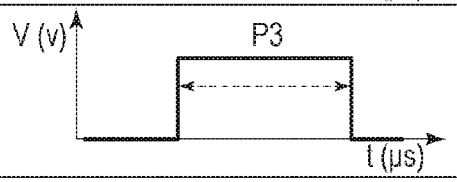  P1:0μs P2:0μs P3:0.56μs |
FIG. 7B
| INK TEMPERATURE | BELOW 20°C | 20°C OR ABOVE BUT BELOW 30°C | 30°C OR ABOVE BUT BELOW 40°C | 40°C OR ABOVE BUT BELOW 50°C | 50°C OR ABOVE BUT BELOW 60°C | 60°C OR ABOVE BUT BELOW 70°C | 70°C OR ABOVE |
|---|---|---|---|---|---|---|---|
| DRIVING PULSE | No.6 | No.5 | No.4 | No.3 | No.2 | No.1 | No.0 |

FIG. 14

| DIFFERENCE x BETWEEN TOTAL PULSE WIDTH AND UPPER LIMIT VALUE (μs) | | | P2 CORRECTION AMOUNT (μs) | P3 CORRECTION AMOUNT (μs) |
|---|---|---|---|---|
| | x= | 0.000 | 0.000 | 0.000 |
| 0.000 | <x≤ | 0.008 | −0.007 | −0.001 |
| 0.008 | <x≤ | 0.016 | −0.015 | −0.001 |
| 0.016 | <x≤ | 0.024 | −0.022 | −0.002 |
| 0.024 | <x≤ | 0.032 | −0.029 | −0.003 |
| 0.032 | <x≤ | 0.040 | −0.036 | −0.004 |
| 0.040 | <x≤ | 0.048 | −0.044 | −0.004 |
| 0.048 | <x≤ | 0.056 | −0.051 | −0.005 |
| 0.056 | <x≤ | 0.064 | −0.058 | −0.006 |
| 0.064 | <x≤ | 0.072 | −0.065 | −0.007 |
| 0.072 | <x≤ | 0.080 | −0.073 | −0.007 |
| 0.080 | <x≤ | 0.088 | −0.080 | −0.008 |
| 0.088 | <x≤ | 0.096 | −0.087 | −0.009 |
| 0.096 | <x≤ | 0.104 | −0.095 | −0.009 |

INK JET PRINTING APPARATUS AND INK JET PRINTING METHOD

BACKGROUND OF THE INVENTION

Field of the Invention

The present invention relates to an ink jet printing apparatus and an ink jet printing method.

Description of the Related Art

Conventionally, an ink jet printing apparatus is known that has a printing head including a printing element substrate, on which a plurality of arrays of printing elements that produces energy for ejecting ink is provided, and drives the printing element by applying a driving pulse to the printing element according to transferred printing data to eject ink on a printing medium to print an image. Such an ink jet printing apparatus is known to use a driving pulse which is constituted by a pre-pulse that heats ink to a temperature not as high as the temperature causing ejection of the ink and a main pulse that causes ejection of the ink.

It is known that, at the ejection of ink, the higher the ink temperature around the printing element is, the greater the viscosity and the surface tension of the ink change, which may increase the ink ejection volume. This increase in ink ejection volume might cause deterioration in the quality of a printed image, which depends on the temperature of ejected ink. Regarding this problem, Japanese Patent Application Laid-Open No. H5-31905 discloses a technique of selecting a driving pulse having a small pre-pulse width for a high ink temperature, from a driving pulse table specifying a plurality of driving pulses having different pre-pulse widths, and applying the selected driving pulse to printing elements. Japanese Patent Application Laid-Open No. H5-31905 discloses that the ejection of ink can be controlled to keep the ink ejection volume approximately constant under different ink temperatures to suppress the deterioration in image quality.

Japanese Patent Application Laid-Open No. 2013-184315 discloses a technique of selecting a driving pulse according to ink temperature and then adjusting the width of the selected driving pulse to adjust ejection energy. Japanese Patent Application Laid-Open No. 2013-184315 also discloses that, if the pulse width of the driving pulse resulting from the adjustment is larger than a predetermined threshold, the driving pulse width is readjusted to be smaller than the predetermined threshold.

It has been known however that under a conventional drive control using a driving pulse, deviation in ink landing position and transfer errors of printing data might occur.

When a driving pulse is applied to a printing element, a current flows in a power supply line for driving the printing element. The current may cause induction noise in a flexible wire connecting the ink jet printing apparatus to the printing head or in a wire inside the printing head. Generally, the induction noise is known to become intense as the change in current per unit time increases. That is, an intense noise might be produced at timings at the leading edge and the trailing edge of each of a main pulse and a pre-pulse that constitute the applied driving pulse, namely, at so-called driving pulse edges.

When timings of leading edges and trailing edges of driving pulses each applied to each of a plurality of printing element arrays occur at the same timing, a significant induction noise occurs. By the effect of an intense induction noise, a crosstalk noise might occur in a signal of printing data for printing, resulting in defects such as deviation in ink landing position and transfer errors of printing data.

SUMMARY OF THE INVENTION

The present invention is made in view of solving the aforementioned problem. An objective of the present invention is to minimize image defects caused by occurrence of an intense induction noise.

An example of the embodiment of the present invention is an ink jet printing apparatus for performing printing by using a print head that includes a substrate and a plurality of printing element arrays provided on the substrate and that ejects ink according to transmitted data, each of the plurality of printing element arrays having a plurality of printing elements which produces energy for ejecting ink by applying a driving pulse, the driving pulse including a pre-pulse which is applied from a first timing and a main pulse which is applied from a second timing later than the first timing. The ink jet printing apparatus includes a first determination unit configured to determine the driving pulses corresponding to the plurality of printing element arrays as a plurality of first driving pulses, an obtaining unit configured to obtain an overlapping value related to the number of overlapped timings among the first timings and the second timings of the plurality of first driving pulses, determined by the first determination unit, corresponding to the plurality of printing element arrays, a second determination unit configured to determine the driving pulses, according to the overlapping value obtained by the obtaining unit, to be applied to the plurality of printing element arrays as a plurality of second driving pulses, and a control unit configured to control ejecting ink from the plurality of printing element arrays based on the plurality of second driving pulses determined by the second determination unit. The second determination unit determines the plurality of first driving pulses determined by the first determination unit as the plurality of second driving pulses, when the overlapping value obtained by the obtaining unit is smaller than a predetermined threshold, and determines a plurality of third driving pulses which is not the plurality of first driving pulses as the plurality of second driving pulses, when the overlapping value obtained by the obtaining unit is larger than the predetermined threshold.

Further features of the present invention will become apparent from the following description of exemplary embodiments (with reference to the attached drawings).

BRIEF DESCRIPTION OF THE DRAWINGS

FIGS. 7A and 7B are figures for explaining typical driving pulse control.

FIG. 14 is a figure for explaining the processing of modulating a total pulse width in the embodiment.

DESCRIPTION OF THE EMBODIMENTS

A first embodiment of the present invention will be described in detail below with reference to the drawings.

First Embodiment

Figure 1:
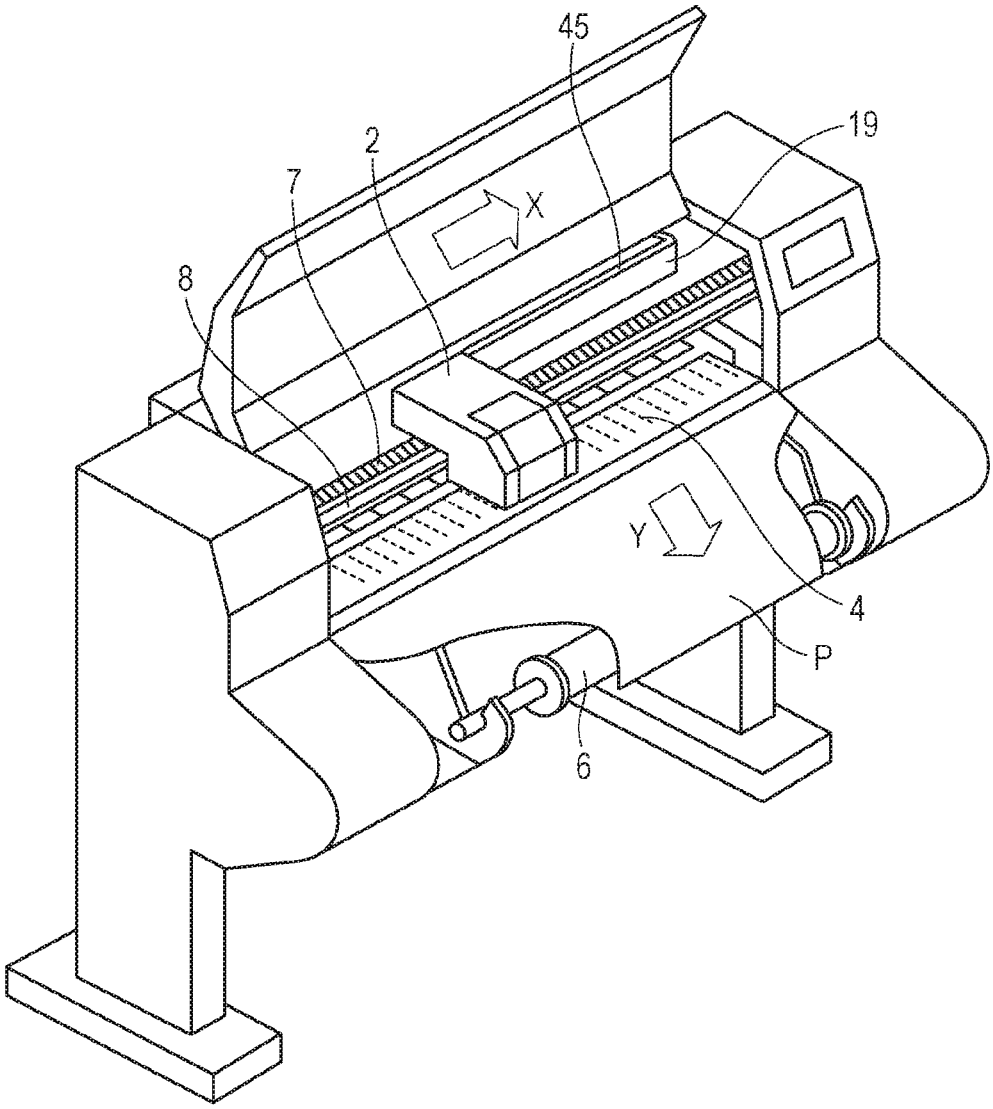
FIG. 1 is a perspective view of an ink jet printing apparatus according to an embodiment.

FIG. 1 illustrates an external appearance of an ink jet printing apparatus according to the embodiment (hereinafter also referred as printer). The printer is a so-called serial scanning printer that prints an image by scanning a printing head in a crossing direction (X direction) perpendicular to the conveyance direction (Y direction) of a printing medium P.

The configuration and the operation of the ink jet printing apparatus will schematically be described using FIG. 1. A printing medium P is conveyed in Y direction on a spool 6 supporting the printing medium P by a conveyance roller that is driven by a conveyance motor (not shown) via a gear. Meanwhile, a carriage unit 2 is swept, at a predetermined conveyance position, along a guide shaft 8 extending in X direction by a carriage motor (not shown). In this scanning step, an ejection operation is performed at an ejection port of a printing head (described later) detachable to the carriage unit 2 at a timing based on a positional signal obtained by an encoder 7 to perform printing on a certain bandwidth corresponding to the area of an array of ejection ports. The embodiment is configured to perform a scanning at a scanning speed of 40 inches per second and perform an ejection operation at a resolution of 600 dpi (1/600 inches). The printing medium P is then conveyed and the printing is performed for the next band.

The printer may be configured to print an image in a unit area on a printing medium by a single scanning (so-called 1 pass printing) or print an image by a plurality of scannings (so-called multipass printing). In a 1 pass printing, a printing medium may be conveyed a distance of a bandwidth between scannings. In a multipass printing, instead of conveying a printing medium at each scanning, a plurality of scannings may be performed in a unit area on a printing medium, and then the unit area may be conveyed a distance of approximately one bandwidth. In another method of multipass printing, data reduced by a predetermined mask pattern is printed at each scanning, a printing medium is conveyed a distance of approximately 1/n bandwidth, and then a scanning is performed again. In this manner, printing of an image is completed by performing a plurality of (n times of) scannings and conveyances, in which the nozzle related to printing on the unit area on the printing medium is changed for each scanning.

A carriage belt can be used to transmit a driving force from the carriage motor to the carriage unit 2. Alternatively, instead of using a carriage belt, other types of driving mechanism, for example, a mechanism including a lead screw that extends in X direction to be rotated by a carriage motor and an engaging portion that is provided in the carriage unit 2 to engage with a groove of the lead screw can be used.

The fed printing medium P is held between a sheet feed roller and a pinch roller to be conveyed to a printing position (the main scanning area of the printing head) on a platen 4. Since an orifice face of the printing head is usually capped when the printing head is not operating, the cap is removed before printing to set the printing head or the carriage unit 2 to be ready for scanning. Then, when data for one scanning is stored in a buffer, the carriage motor scans the carriage unit 2 to perform printing as described above.

A flexible wiring substrate 190 for supplying a driving pulse for ejection drive and a head temperature adjustment signal is attached to the printing head. The other end of the flexible substrate is connected to a controller (not shown) including a control circuit, such as a CPU, for controlling the printer. A thermistor (not shown), which serves as a temperature sensor for detecting an atmospheric temperature inside the ink jet printing apparatus is provided near the controller.

Figure 2:
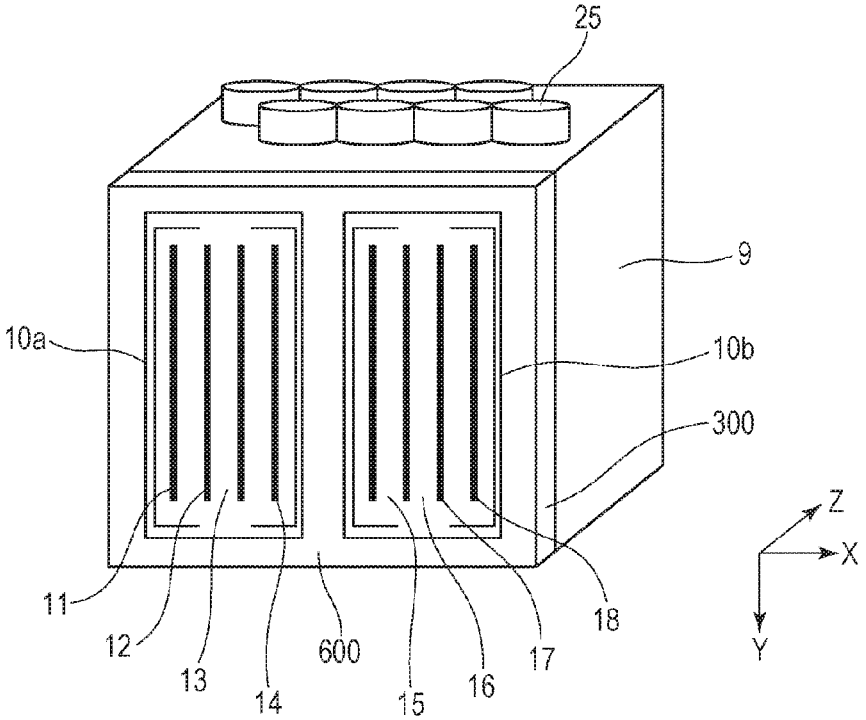
FIG. 2 is a schematic diagram of a printing head according to the embodiment.

FIG. 2 is a perspective view schematically illustrating a printing head 9 according to the embodiment.

A joint 25 is formed on the printing head 9, and an ink supply tube is connected to the joint 25.

Two printing element substrates 10*a* and 10*b* each composed of, for example, a semiconductor, are attached to the ejection port forming face, which opposes the printing medium P, of the printing head 9. The printing element substrates 10*a* and 10*b* are each provided with ejection ports arrayed along Y direction perpendicular to X direction. Specifically, the printing element substrate 10*a* has an ejection port array 11 that ejects black (Bk) ink, an ejection port array 12 that ejects grey (Gy) ink, an ejection port array 13 that ejects light grey (Lgy) ink, and an ejection port array 14 that ejects light cyan (Lc) ink, which ejection port arrays being arranged along X direction. The printing element substrate 10*b* has an ejection port array 15 that ejects cyan (C) ink, an ejection port array 16 that ejects light magenta (Lm) ink, an ejection port array 17 that ejects magenta (M) ink, and an ejection port array 18 that ejects yellow (Y) ink, which ejection port arrays being arranged along X direction.

As will be described later, printing element arrays are formed in the printing element substrates 10*a* and 10*b* so as to respectively oppose the ejection port arrays 11 to 18. Hereinafter, for convenience of description, the printing element arrays respectively opposing the ejection port arrays 11 to 18 will respectively be referred as printing element arrays 11*x* to 18*x*.

The printing element substrates 10*a* and 10*b* are fixed by an adhesive to a support member 300 made of, for example, alumina or resin. The printing element substrates 10*a* and 10*b* are electrically coupled to an electric wiring member 600 provided with wiring and communicate using signals with the printing head 9 via the electric wiring member 600.

Figure 3A:
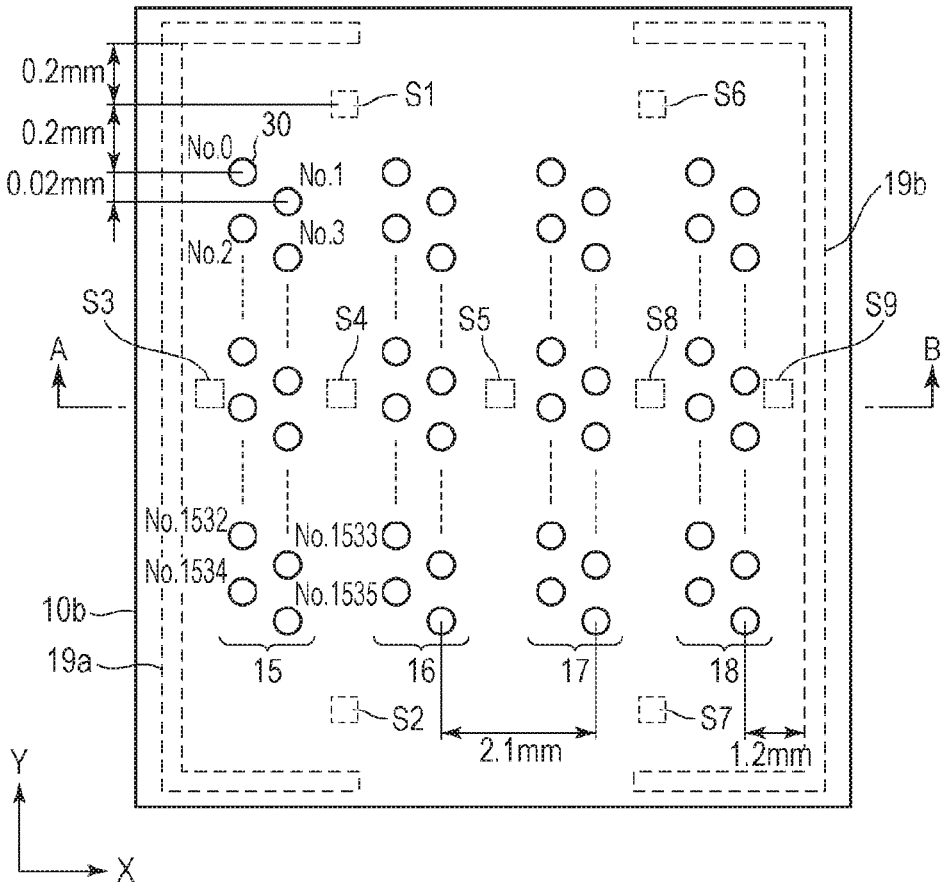
FIGS. 3A and 3B are transparent views of the printing head according to the embodiment.
Figure 3B:
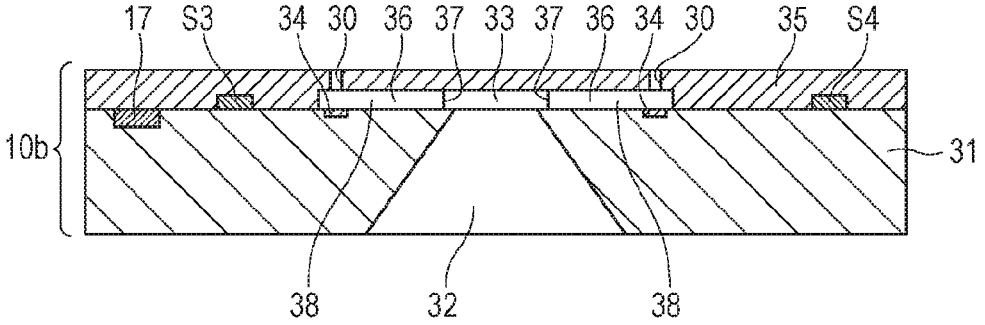

FIG. 3A is a transparent view of the printing element substrate 10*b* viewed in a direction normal to XY plane. FIG. 3B is a sectional view of a portion of the printing element substrate 10*b* around the ejection port array 15 taken along a plane that is perpendicular to the printing element substrate 10*b* and includes the line AB in FIG. 3A, viewed along the direction from minus Y to plus Y. While the figures in FIGS. 3A and 3B are simply illustrated with dimensional ratios of parts not identical to actual parts for simplicity, the actual size of the printing element substrate 10*b* is 9.55 mm in X direction and 39.0 mm in Y direction.

Each of the ejection port arrays 11 to 18 of the embodiment is composed of two rows. Each of the two rows is composed of 768 ejection ports 30 arranged in Y direction (arranging direction). The two opposing rows are shifted from each other by a dot pitch of 1200 dpi (dot/inch) in Y direction. Printing elements (hereinafter also referred as main heaters) 34 serving as an electrothermal transducing elements are arranged in Y direction (predetermined direction) so as to oppose the 1536 ejection ports 30 in total. In the embodiment, a dot pitch of 1200 dpi is approximately 0.02 mm. Thermal energy for ejecting ink from the ejection port can be produced by providing a pulse to the printing element. Although the electrothermal transducing element is used as the printing element in the embodiment, a piezoelectric transducer can be also used as the printing element.

Nine diode sensors S1 to S9 are formed on the printing element substrate 10*b* as temperature sensors for detecting ink temperature near the printing element.

Two diode sensors S1 and S6 are positioned near one of Y directional ends of the ejection port arrays 15 to 18. Specifically, the diode sensors S1 and S6 are positioned to be 0.2 mm in Y direction from the ejection port 30 at the Y directional end. The diode sensor S1 is positioned in the middle in X direction between the ejection port array 15 and the ejection port array 16, and the diode sensor S6 is positioned in the middle in X direction between the ejection port array 17 and the ejection port array 18.

Two diode sensors S2 and S7 are positioned near the other Y directional end of the ejection port arrays 15 to 18. The diode sensor S2 is positioned in the middle in X direction between the ejection port array 15 and the ejection port array 16, and the diode sensor S7 is positioned in the middle in X direction between the ejection port array 17 and the ejection port array 18. Specifically, the diode sensors S2 and S7 are positioned to be 0.2 mm in Y direction from the ejection port at the other Y directional end.

Along Y direction, five diode sensors S3, S4, S5, S8, and S9 are positioned at a center portion of the ejection port arrays 15 to 18, that is, at half the length from an end of the ejection port arrays 15 to 18. The diode sensor S4 is positioned in the middle in X direction between the ejection port array 15 and the ejection port array 16, the diode sensor S5 is positioned in the middle in X direction between the ejection port array 16 and the ejection port array 17, and the diode sensor S8 is positioned in the middle in X direction between the ejection port array 17 and the ejection port array 18. The diode sensor S3 is positioned outside (further near the rim of the printing element substrate 10*b*) in X direction than the ejection port array 15, and the diode sensor S9 is positioned outside (further near the rim of the printing element substrate 10*b*) in X direction than the ejection port array 18.

In the embodiment, the temperature of the ink inside the ejection port near the diode sensor is approximately identical to the local temperature of the printing element substrate 10*b* at the position where the diode sensor is provided. Thus, the temperature of the printing element substrate 10*b* is assumed as the ink temperature.

Heating elements (hereinafter also referred as sub-heater) 19*a* and 19*b* for heating the ink inside the ejection port is provided on the printing element substrate 10*b*. The heating element 19*a* is formed in a continuous member that covers the ejection port array 15 in X direction from the side where the diode sensor S3 is provided. The heating element 19*b* is formed in a continuous member that covers the ejection port array 18 in X direction from the side where the diode sensor S9 is provided. Portions of the heating elements 19*a* are provided 1.2 mm outside in X direction from the ejection port array 15, 0.2 mm outside in Y direction from the diode sensor S1, and 0.2 mm outside in Y direction from the diode sensor S2. Portions of the heating elements 19*b* are provided 1.2 mm outside in X direction from the ejection port array 18, 0.2 mm outside in Y direction from the diode sensor S6, and 0.2 mm outside in Y direction from the diode sensor S7.

The printing element substrate 10*b* is configured with diode sensors S1 to S9, sub-heaters 19*a* and 19*b*, a substrate 31 on which various circuits are formed, and an ejection port member 35 formed of resin. A common ink chamber 33 is formed between the substrate 31 and the ejection port member 35. The common ink chamber 33 communicates with an ink supply port 32. An ink passage 36 extends from the common ink chamber 33 to communicate with the ejection port 30 formed in the ejection port member 35. A bubble generating chamber 38 is formed at the end portion of the ink passage 36 near the ejection port 30. The printing element (main heater) 34 is provided in the bubble generating chamber 38 so as to oppose the ejection port 30. A nozzle filter 37 is formed between the ink passage 36 and the common ink chamber 33.

The printing element substrate 10*a* has approximately the same configuration as the printing element substrate 10*b* described in detail above.

In the embodiment, for each of the printing element arrays 15*x* to 18*x*, a representative temperature is calculated based on temperatures detected by a combination of diode sensors S1 to S9, and according to the calculated representative temperature, driving pulse control is performed. The combination of diode sensors is different among printing element arrays. Specifically, to perform driving pulse control for the printing element array 15*x*, the representative temperature is the average of temperatures detected by four diode sensors S1, S2, S3, and S4 that surround the printing element array 15*x*. To perform driving pulse control for the printing element array 16*x*, the representative temperature is the average of temperatures detected by four diode sensors S1, S2, S4, and S5 that surround the printing element array 16*x*. To perform driving pulse control for the printing element array 17*x*, the representative temperature is the average of temperatures detected by four diode sensors S5, S6, S7, and S8 that surround the printing element array 17*x*. To perform driving pulse control for the printing element array 18*x*, the representative temperature is the average of temperatures detected by four diode sensors S6, S7, S8, and S9 that surround the printing element array 18*x*.

The method of calculating the representative temperature is not limited to the method described above. For example, the representative temperature may be calculated using the maximum temperature among temperatures detected by four diode sensors surrounding each of the printing element arrays 15*x* to 18*x*. Alternatively, the representative temperature of every one of the printing element arrays 15*x* to 18*x* may be calculated using the average value of temperatures detected by nine diode sensors S1 to S9 provided on the printing element substrate 10*b*. Furthermore, the embodiment need not have a plurality of diode sensors in the printing head 9 as illustrated in FIG. 3A, but may have at least one diode sensor.

Figure 4:
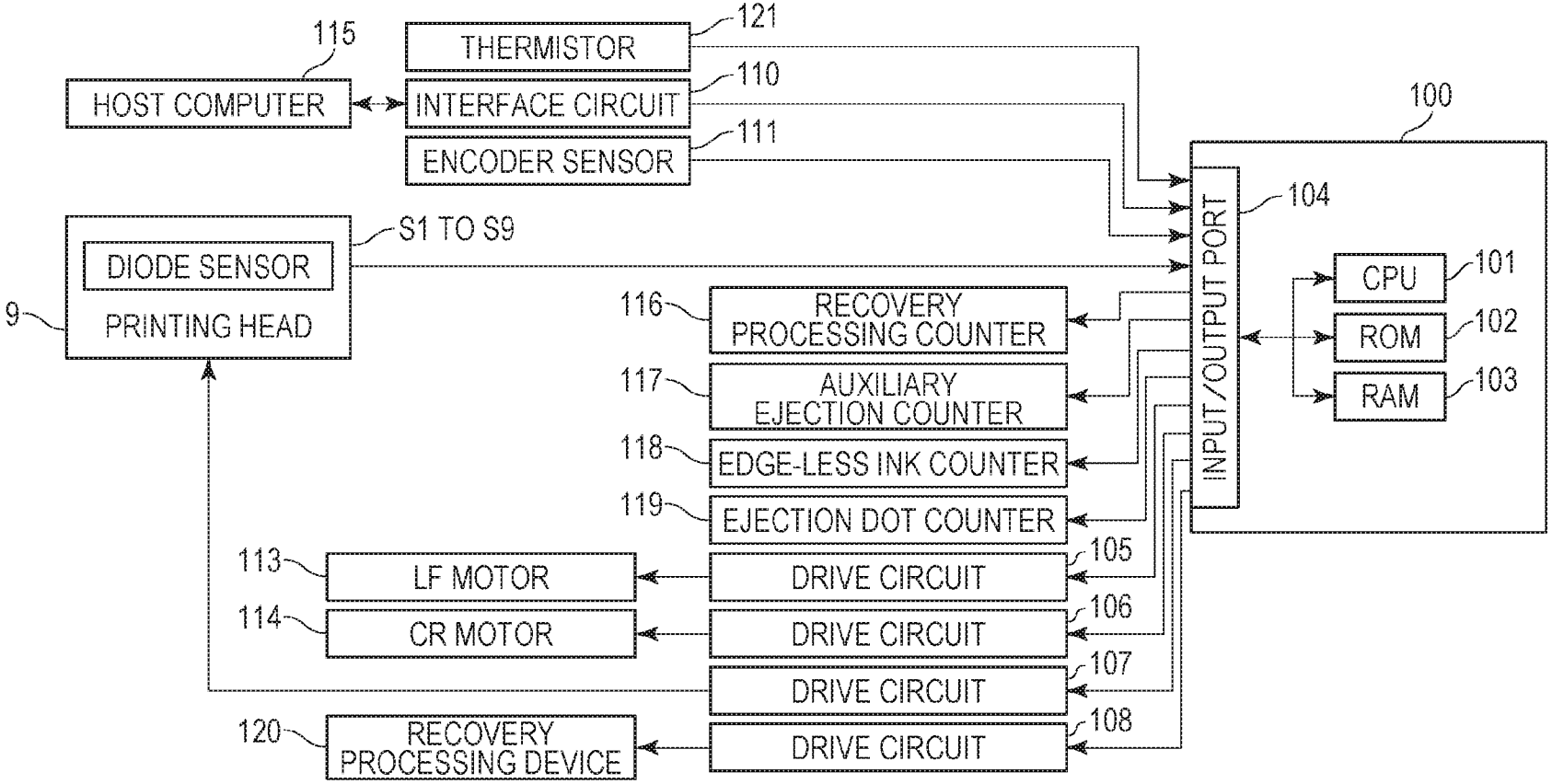
FIG. 4 is a figure illustrating a print control system of the embodiment.

FIG. 4 is a block diagram illustrating the configuration of a control system provided to the ink jet printing apparatus according to the embodiment. A main controller 100 includes a CPU 101 that executes a processing operation, such as processing, control, determination, and setting. The main controller 100 includes a ROM 102 that stores control programs to be executed by the CPU 101, a buffer that stores binary printing data representing ejection/non-ejection of ink, a RAM 103 that is used as a work area for the processing executed by the CPU 101, and an input/output port 104. The RAM 103 can also be used as a storing unit for storing data on the amount of ink in the main tank and a free space in the sub-tank before and after a printing operation. A conveyance motor (LF motor) 113 that drives the conveyance roller, a carriage motor (CR motor) 114, a printing head 9, and drive circuits 105, 106, 107, and 108 for driving, for example, a recovery processing device 120, are coupled to the input/output port 104. The main controller 100 controls the drive circuits 105, 106, 107, and 108. Sensors, such as the diode sensors S1 to S9 for detecting the temperature of the printing head 9, an encoder sensor 111 fixed to the carriage unit 2, and a thermistor 121 that detects the atmospheric temperature (environment temperature) inside the printing apparatus is coupled to the input/output port 104. The main controller 100 is coupled to a host computer 115 via an interface circuit 110.

The drive circuit 107 serving as a signal transmitter to the printing head transmits a driving pulse to be applied as well as printing data for printing. These signals are transferred via the flexible wiring substrate 190.

A recovery processing counter 116 counts the amount of ink that is forcibly ejected from the printing head 9 by the recovery processing device 120. An auxiliary ejection counter 117 counts at the start or completion of printing auxiliary ejections performed during printing. An edge-less ink counter 118 counts the ink printed outside the region on the printing medium during edge-less printing. An ejection dot counter 119 counts the ink ejected during printing.

Driving Pulse Control

A typical example of a so-called driving pulse control in which one of a plurality of driving pulses is selected according to the ink temperature, the selected driving pulse is applied to the printing element 34 to heat the printing element 34, and the resulting thermal energy is used to eject ink will be described below in detail.

In the embodiment, a so-called double pulse composed of a pre-pulse and a main pulse is used as a driving pulse to be applied.

Figure 5:
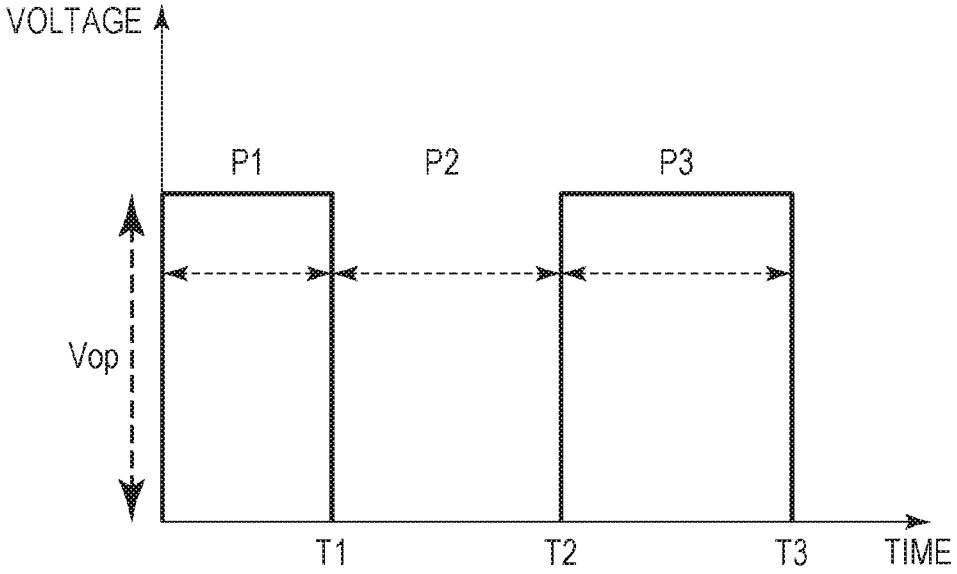
FIG. 5 is a figure for explaining a driving pulse.

FIG. 5 is a figure for explaining the double pulse. In the figure, Vop is a driving voltage, P1 is a pre-pulse width, P2 is a time interval, and P3 is a main pulse width. The pre-pulse plays an important role because ink ejection is controlled by controlling the pre-pulse width.

The pre-pulse is a pulse that is applied for heating mainly the ink near the printing element 34 to facilitate bubbling. The pre-pulse width is set to be not larger than the pulse width that generates energy smaller than the boundary energy that causes bubbling of ink.

The time interval is a time period between the pre-pulse and the main pulse. The time interval is set such that the heat generated by applying the pre-pulse is sufficiently transferred to the ink near the printing element 34. The main pulse is a pulse used for bubbling ink so that the ink is ejected as a droplet.

Figure 6A:
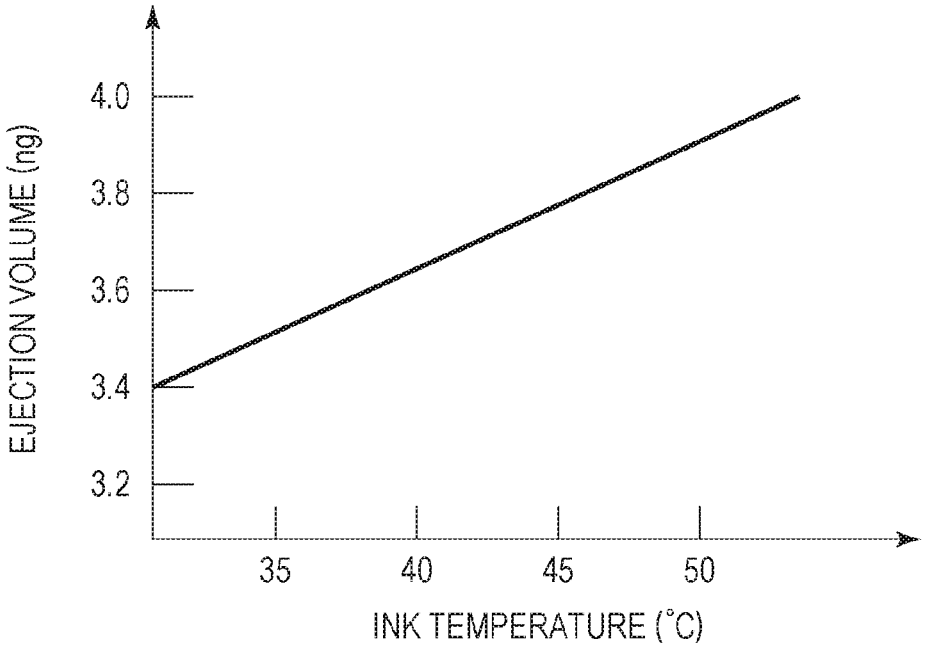
FIGS. 6A and 6B are figures for explaining a correlation among an ink temperature, a driving pulse, and an ink ejection volume.

FIG. 6A is a figure illustrating the correlation between the ink temperature and the ink ejection volume under a condition where the waveform of the driving pulse applied to the printing element 34 and the driving voltage Vop are fixed. It can be understood from the figure that the ink ejection volume increases as the ink temperature rises.

Figure 6B:
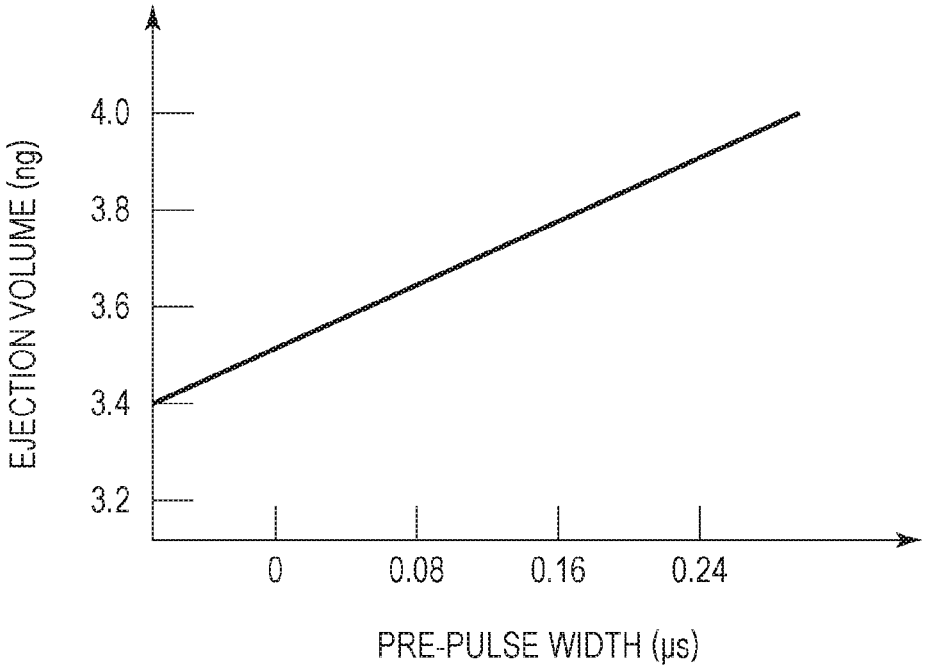

FIG. 6B is a figure illustrating the correlation between the pre-pulse width and the ink ejection volume under a constant ink temperature condition where the time interval and the driving voltage Vop are fixed. From the figure, it can be understood that the ink ejection volume Vd proportionally increases as the pre-pulse width P1 increases. As the pre-pulse width P1 increases, thereby increasing the amount of energy provided by the pre-pulse, the ink temperature rises and thereby the ink viscosity is reduced. When a main pulse is applied to the ink with low viscosity, the ink ejection volume increases. In contrast, when the main pulse is applied to the ink of which viscosity has not sufficiently been reduced, the ink ejection volume decreases.

In a typical driving pulse control, the fluctuation in the ink ejection volume caused by the change in the substrate temperature (ink temperature) is suppressed by changing the pre-pulse width according to the ink temperature. Specifically, when the ink temperature is relatively low, the ink ejection volume might decrease, so that the pre-pulse width P1 of the driving pulse applied to the printing element 34 is set to a relatively large value. In this manner, the chances of decrease in the ink ejection volume can be suppressed. When the ink temperature is relatively high, the pre-pulse width P1 is set to a relatively small value.

FIG. 7A is a figure illustrating waveforms of the driving pulses having different pre-pulse widths P1.

The driving voltage is the same among seven driving pulses from No. 0 to No. 6. The time interval P2 is the same (P2=0.30 μs) among the driving pulses from No. 1 to No. 6. No. 0 driving pulse is a so-called single pulse that has no pre-pulse (P1=0 μs). The pre-pulse width P1 and the main pulse width P3 are set to be different among the driving pulses from No. 0 to No. 6.

Specifically, among seven driving pulses, No. 0 driving pulse is set to have the smallest pre-pulse width P1 (P1=0 μs) and the largest main pulse width P3 (P3=0.56 μs).

No. 1 driving pulse is set to have the pre-pulse width P1 that is 0.08 μs larger than No. 0 driving pulse (P1=0.08 μs) and the main pulse width P3 that is 0.08 μs smaller than No. 0 driving pulse (P3=0.48 μs).

From No. 2 to No. 6 driving pulses, the pre-pulse width P1 increases by 0.08 μs and the main pulse width P3 decreases by 0.08 μs for each increment of the number of driving pulse.

Among seven driving pulses, No. 6 driving pulse has the largest pre-pulse width P1 (P1=0.48 μs) and the smallest main pulse width P3 (P3=0.08 μs).

As illustrated in FIG. 7B, a larger pre-pulse width P1 causes a greater ink ejection volume. Thus, when the driving pulses from No. 0 to No. 6 illustrated in FIG. 7A are each applied to the printing element 34 under the same ink temperature condition, the volume of ink ejected by applying No. 0 driving pulse is the smallest and the volume of ink ejected by applying No. 6 driving pulse is the largest. Since the pre-pulse width P1 increases by the same increment of 0.08 μs for each increment of the number of the driving pulses from No. 0 to No. 6, the ink ejection volume increases by an approximately same volume for each increment of the number of driving pulse.

FIG. 7B is a table illustrating the correlation between the ink temperature and the driving pulse actually applied to the printing element 34.

As described above, a higher ink temperature causes a greater ink ejection volume. In the embodiment, to suppress the fluctuation in the ink ejection volume caused by the change in ink temperature, a driving pulse having a smaller pre-pulse width P1 is selected and applied for a higher ink temperature.

For example, as illustrated in FIG. 7B, when the ink temperature is below 20° C., which is a relatively low temperature, No. 6 driving pulse, of which pre-pulse widthP1 is relatively large as illustrated in FIG. 7A, is selected. When the ink temperature is as high as 70° C. or above, which is a relatively high temperature, No. 0 driving pulse, of which pre-pulse width P1 is relatively small as illustrated in FIG. 7A, is selected.

Figure 8:
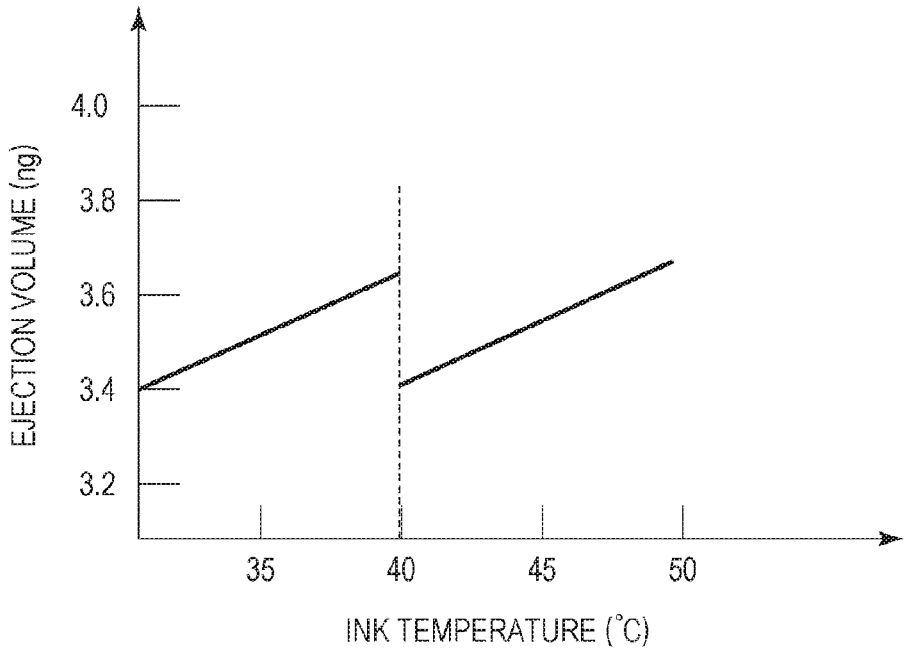
FIG. 8 is a figure for explaining a correlation between the temperature and the ejection volume when the driving pulse control is performed.

FIG. 8 is a figure illustrating the correlation between the ink temperature and the ink ejection volume when the driving pulse is selected as illustrated in FIGS. 7A and 7B and applied.

From 30° C. to 40° C. in the temperature range illustrated in FIG. 8, No. 4 driving pulse is applied to the printing element 34 as illustrated in FIG. 7B. From 30° C. to 40° C., the ink ejection volume increases as the ink temperature rises, like in FIG. 6A.

When the ink temperature exceeds 40° C., the driving pulse to be applied switches to No. 3 driving pulse, which has a smaller pre-pulse width than No. 4 driving pulse. Therefore, the increase in ink ejection volume is suppressed as illustrated in FIG. 8. By performing driving pulse control in this manner, printing can be performed with the change in ink ejection volume suppressed even when the ink temperature changes.

Driving Pulse Control According to the Overlapped Level of Invert Timing

As described above, four printing element arrays are provided on each of the printing element substrates 10*a* and 10*b* provided on the printing head 9 used in the embodiment.

Regarding four driving pulses that are simultaneously applied to four printing element arrays provided on a single printing element substrate, when timings of the leading edge and the trailing edge of each of the pre-pulse and the main pulse (hereinafter also referred as invert timing), namely, the timings of edges of driving pulses, are overlapped, a large current flows in a power source line for driving the printing element 34 at the timing. The large current produces an induction noise in the wiring provided in the electric wiring member 600, which might cause deterioration in printing quality. The induction noise becomes intense as the number of overlapped invert timings increases among simultaneously applied driving pulses.

Therefore, in the embodiment, the number of overlapped invert timings of simultaneously applied driving pulses (hereinafter also referred as overlapped level of invert timing) is calculated for each timing, and the maximum overlapped level of invert timing is calculated. When the calculated maximum overlapped level of invert timing is equal to or higher than a predetermined threshold, an intense induction noise might occur, so the driving pulse to be applied is changed. The predetermined threshold is set to 3 in the embodiment. That is, an intense induction noise is assumed to occur when invert timings of three driving pulses, among four driving pulses applied to the printing element arrays 15*x* to 18*x*, are overlapped.

Although the driving pulse is applied to a plurality of printing elements of each printing element array at the same timing for simplicity of description, the timing of applying a driving pulse may be shifted by a predetermined amount among printing elements.

Figure 9:
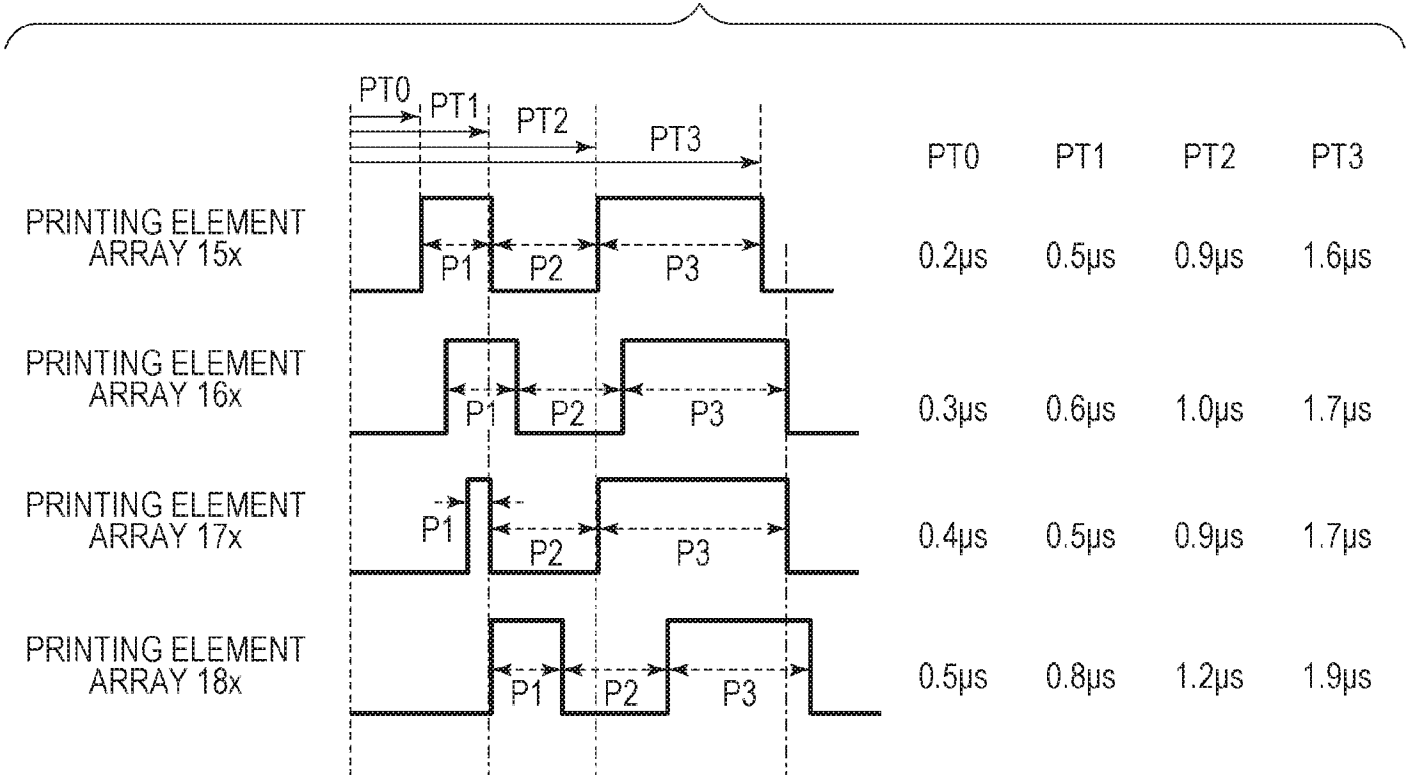
FIG. 9 is a figure for explaining a method of calculating an overlapped level of invert timing.
Figure 16:
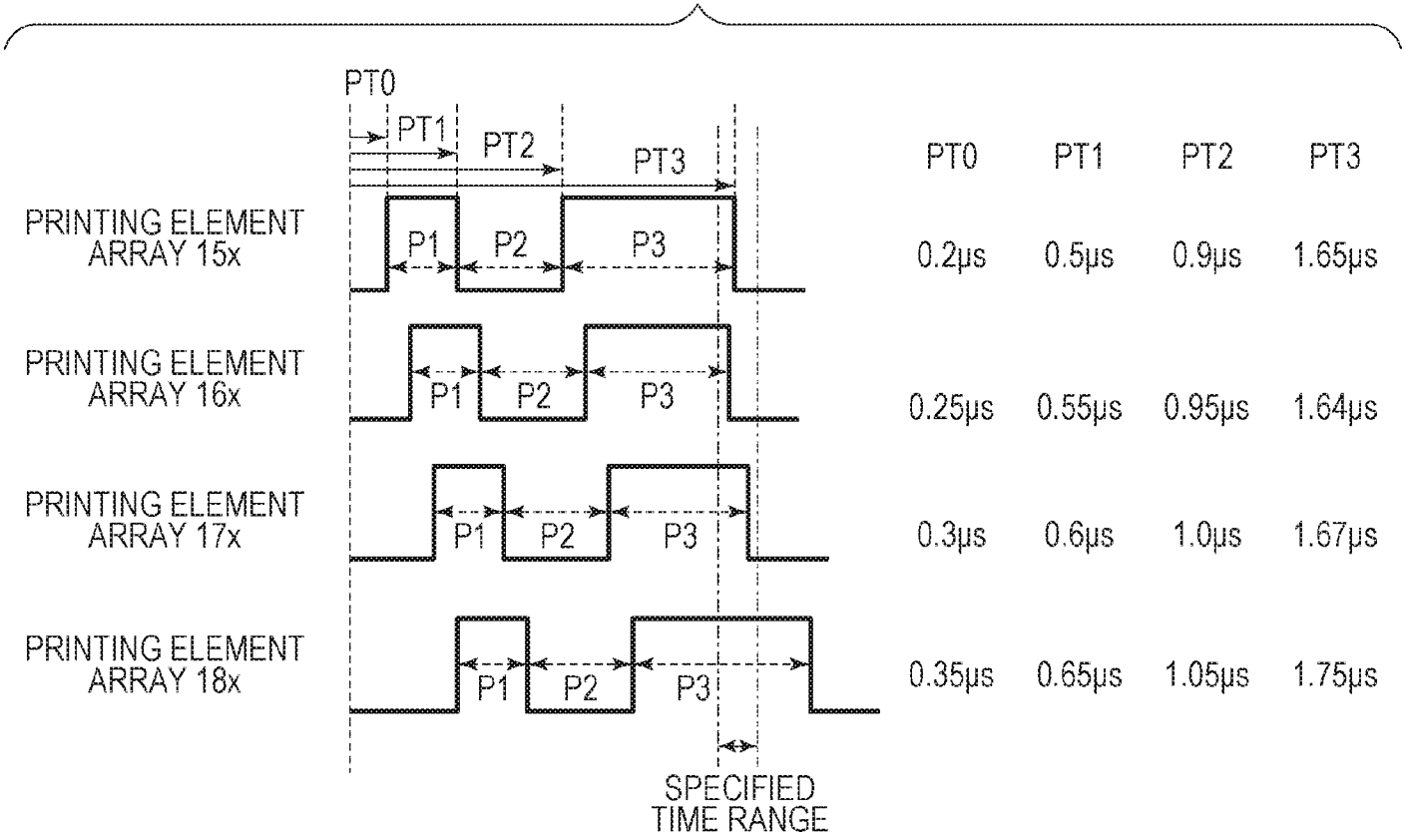
FIG. 16 is a figure for explaining a method of calculating the overlapped level of invert timing.

FIG. 9 is a figure for explaining a method of calculating the overlapped level of invert timing of driving pulses. An example of driving pulses applied to four printing element arrays 15*x* to 18*x* provided on the printing element substrate 10*b* is illustrated in FIG. 16.

Among a plurality of invert timings, the timing of the leading edge of the pre-pulse is referred as invert timing PT0, the timing of the trailing edge of the pre-pulse is referred as invert timing PT1, the timing of the leading edge of the main pulse is referred as invert timing PT2, and the timing of the trailing edge of the main pulse is referred as invert timing PT3 hereinafter in the description. The invert timings PT0, PT1, PT2, and PT3 are each represented by an offset from a common reference timing. Therefore, when the offset from the reference timing to the leading edge of the pre-pulse is given as P0, the pre-pulse width as P1, the time interval as P2, and the main pulse width as P3, equations are expressed as follows: PT0=P0; PT1=P0+P1; PT2=P0+P1+P2; and PT3=P0+P1+P2+P3. In other words, the pre-pulse width P1 corresponds to the time interval between invert timings PT0 and PT1, the time interval P2 corresponds to the time interval between invert timings PT1 and PT2, and the main pulse width P3 corresponds to the time interval between invert timings PT2 and PT3. The driving voltage for each driving pulse illustrated in FIG. 9 is 24 V.

As illustrated in FIG. 9, for the driving pulse applied to the printing element array 15*x*, the offset P0 to the leading edge of the pre-pulse is 0.2 μs, the pre-pulse width P1 is 0.3 μs, the time interval P2 is 0.4 μs, and the main pulse width P3 is 0.7 μs. Therefore, the invert timing PT0 is 0.2 μs, the invert timing PT1 is 0.5 μs, the invert timing PT2 is 0.9 μs, and the invert timing PT3 is 1.6 μs.

For the driving pulse applied to the printing element array 16*x*, the offset P0 to the leading edge of the pre-pulse is 0.3 μs, the pre-pulse width P1 is 0.3 μs, the time interval P2 is 0.4 μs, and the main pulse width P3 is 0.7 μs. Therefore, the invert timing PT0 is 0.3 μs, the invert timing PT1 is 0.6 μs, the invert timing PT2 is 1.0 μs, and the invert timing PT3 is 1.7 μs.

For the driving pulse applied to the printing element array 17*x*, the offset P0 to the leading edge of the pre-pulse is 0.4 μs, the pre-pulse width P1 is 0.1 μs, the time interval P2 is 0.4 μs, and the main pulse width P3 is 0.8 μs. Therefore, the invert timing PT0 is 0.4 μs, the invert timing PT1 is 0.5 μs, the invert timing PT2 is 0.9 μs, and the invert timing PT3 is 1.7 μs.

For the driving pulse applied to the printing element array 18*x*, the offset P0 to the leading edge of the pre-pulse is 0.5 μs, the pre-pulse width P1 is 0.3 μs, the time interval P2 is 0.4 μs, and the main pulse width P3 is 0.7 μs. Therefore, the invert timing PT0 is 0.5 μs, the invert timing PT1 is 0.8 μs, the invert timing PT2 is 1.2 μs, and the invert timing PT3 is 1.9 μs.

In the embodiment, the number of overlapped invert timings that are overlapped at a certain timing, among the four invert timings PT0, PT1, PT2, and PT3 of a plurality of driving pulses illustrated in FIG. 9, is calculated as the overlapped level of invert timing at the certain timing. Then, the maximum overlapped level of invert timing among the timings is calculated, and when the maximum overlapped level is equal to or higher than 3, the driving pulse to be actually applied is changed.

For example, for the driving pulses illustrated in FIG. 9, the invert timing PT2 of the driving pulse applied to the printing element array 15*x* and the invert timing PT2 of the driving pulse applied to the printing element array 17*x* are overlapped at the timing of 0.9 μs. Therefore, for the driving pulses illustrated in FIG. 9, the overlapped level of invert timing at the timing of 0.9 μs is 2.

Similarly, for the driving pulses illustrated in FIG. 9, the invert timing PT3 of the driving pulse applied to the printing element array 16*x* and the invert timing PT3 of the driving pulse applied to the printing element array 17*x* are overlapped at the timing of 1.7 μs. Therefore, for the driving pulses illustrated in FIG. 9, the overlapped level of invert timing at the timing of 1.7 μs is 2.

For the driving pulses illustrated in FIG. 9, the invert timing PT1 of the driving pulse applied to the printing element array 15*x*, the invert timing PT1 of the driving pulse applied to the printing element array 17*x*, and the invert timing PT0 of the driving pulse applied to the printing element array 18*x* are overlapped at the timing of 0.5 μs. Therefore, for the driving pulses illustrated in FIG. 9, the overlapped level of invert timing at the timing of 0.5 μs is 3.

Consequently, the maximum overlapped level of invert timing is calculated as 3. When driving pulses illustrated in FIG. 9 are actually applied to the printing element arrays 15*x* to 18*x*, the driving pulses to be applied are changed because an intense induction noise might occur.

Driving Pulse Control According to Overlapped Level of Invert Timing

Figure 10:
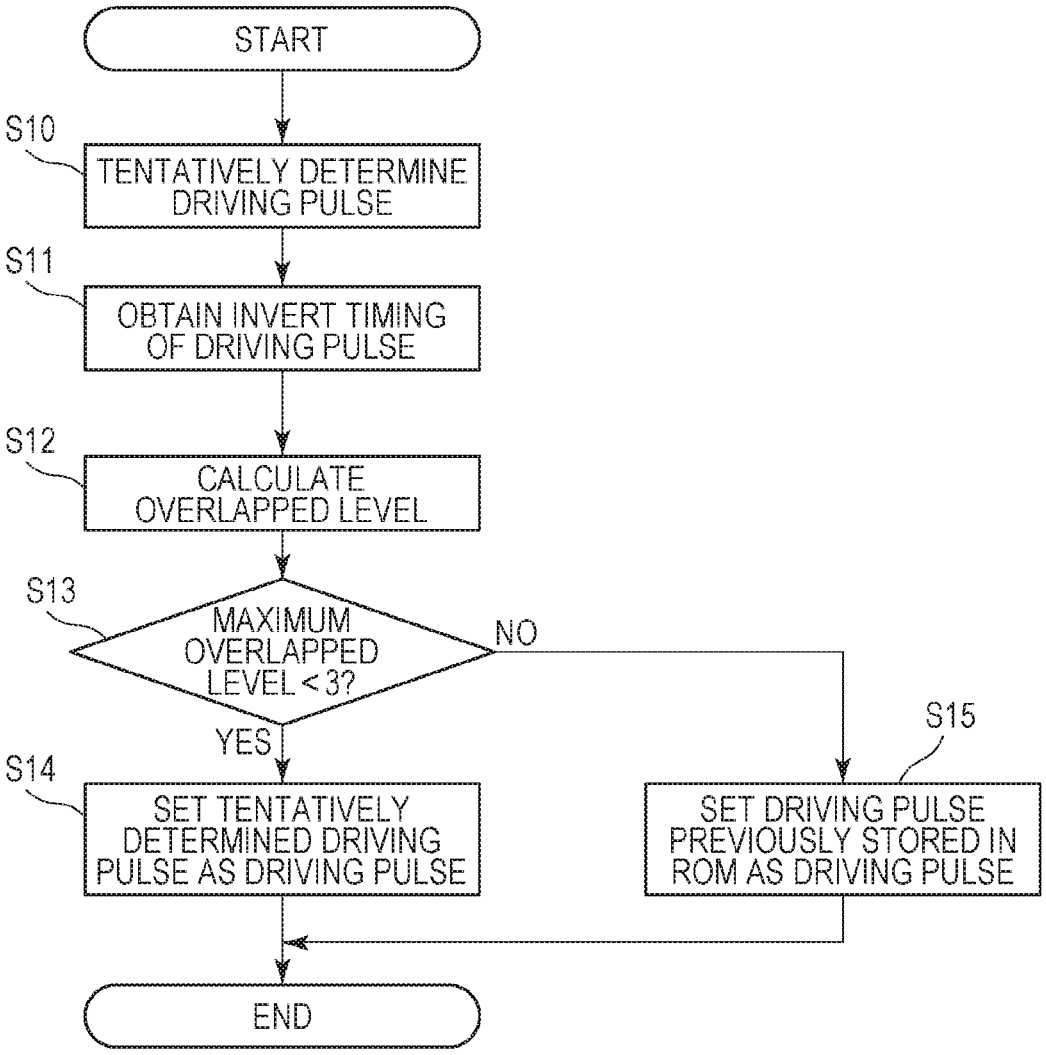
FIG. 10 is a figure for explaining the driving pulse control of the embodiment.

FIG. 10 is a flow chart for explaining driving pulse control of the embodiment. The driving pulse control illustrated in FIG. 10 is performed by the CPU 101.

In the embodiment, the driving pulse control illustrated in FIG. 10 is performed every 5 ms during printing images. The time interval of performing the driving pulse control is not limited to 5 ms and can suitably be set to a different time interval.

When the driving pulse control is performed, processing of tentatively determining a driving pulse is performed in Step S10. In the embodiment, a typical driving pulse control described using FIGS. 7A and 7B is performed as the processing of tentatively determining a driving pulse. Specifically, the representative temperature is obtained for each printing element array, and one driving pulse is tentatively determined for each printing element array based on the obtained representative temperature and the driving pulse table illustrated in FIGS. 7A and 7B. For example, when the representative temperature of the printing element array 15*x* is 25° C., No. 5 driving pulse illustrated in FIG. 7A is tentatively determined as the driving pulse for the printing element array 15*x*. When the representative temperature of the printing element array 17*x* is 65° C., No. 1 driving pulse illustrated in FIG. 7A is tentatively determined as the driving pulse for the printing element array 17*x*. The driving pulse table illustrated in FIGS. 7A and 7B is previously stored in ROM 102.

Then in Step S11, information on invert timings PT0, PT1, PT2, and PT3 of the driving pulse, which are tentatively determined in Step S10, of each of the printing element arrays 15*x* to 18*x* is obtained. For example, when No. 5 driving pulse illustrated in FIG. 7A has tentatively been determined as the driving pulse for the printing element array 15*x*, the offset P0 to the leading edge of the pre-pulse, the pre-pulse width P1, the time interval P2, and the main pulse width P3 of No. 5 driving pulse are respectively 0.00 μs, 0.40 μs, 0.30 μs, and 0.16 μs. Therefore, the invert timings PT0, PT1, PT2, and PT3 of No. 5 driving pulse are respectively 0.00 μs, 0.40 μs, 0.70 μs, and 0.86 μs.

Then in Step S12, the overlapped level of invert timing is calculated based on the invert timings PT0, PT1, PT2, and PT3 of the driving pulse of each of the printing element array 15*x* to 18*x* obtained in Step S11. For example, when No. 5 driving pulse has tentatively been determined for all the printing element arrays 15*x* to 18*x*, the maximum overlapped level of invert timing is 4.

Then, in Step S13, whether the maximum overlapped level of invert timing that is calculated in Step S12 is equal to or higher than 3 is determined.

If the maximum overlapped level of invert timing is determined to be lower than 3, an intense induction noise is not likely to occur when the driving pulse tentatively determined in Step S10 is applied, so the driving pulse tentatively determined in Step S10 is set as the driving pulse to be actually applied (Step S14). In this manner, the ink ejection volume can be controlled to be approximately constant independent of ink temperature.

Meanwhile, if the maximum overlapped level of invert timing is determined to be 3 or higher, an intense induction noise might occur by applying the driving pulse tentatively determined in Step S10, and an image defect might occur. Therefore, driving pulses previously stored in the ROM 102 are read, in such a manner that invert timings of the read driving pulses are not overlapped, and the read driving pulses are set as driving pulses to be actually applied (Step S15).

Figure 11:
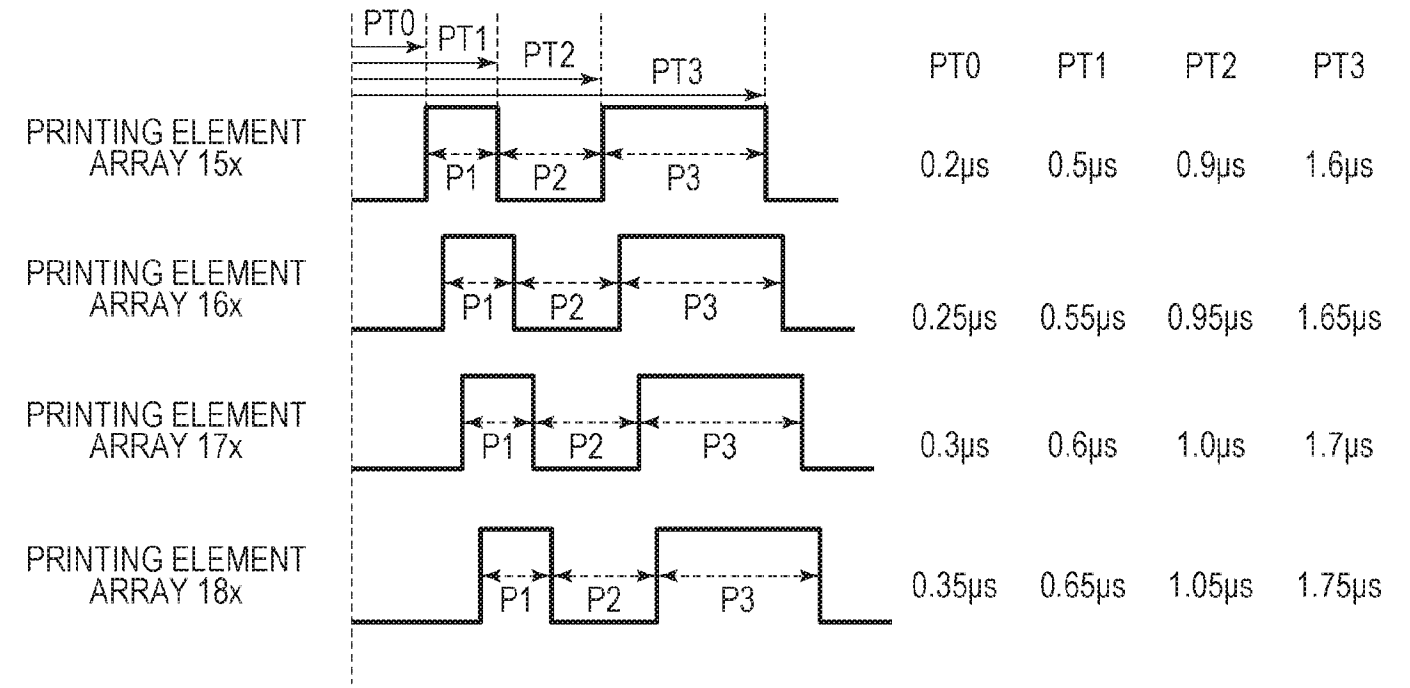
FIG. 11 is a figure illustrating an example of a driving pulse used in the embodiment.

FIG. 11 is a figure illustrating an example of driving pulses, stored in the ROM 102, that have invert timings not overlapped.

Driving pulses used for printing element arrays 15*x* to 18*x* illustrated in FIG. 11 each has the pre-pulse width P1 of 0.30 μs, the time interval P2 of 0.40 μs, and the main pulse width P3 of 0.70 μs. The offset P0 to the leading edge of the pre-pulse is shifted by 0.05 μs for each increment of the number of the printing element array.

As described above, invert timings of the driving pulses illustrated in FIG. 11 are not overlapped. In other words, the driving pulses illustrated in FIG. 11 are set such that the maximum overlapped level of invert timing is 1. Therefore, an intense induction noise is likely not to occur when the driving pulses illustrated in FIG. 11 are applied.

As described above in the embodiment, when the maximum overlapped level of invert timing of driving pulses tentatively determined for a plurality of printing element arrays provided on the same printing element substrate is lower than a predetermined threshold, the tentatively determined driving pulses are set as driving pulses to be actually applied. Thus, the ink ejection volume is kept approximately constant even when the ink temperature changes. When the maximum overlapped level of invert timing is higher than the predetermined threshold, driving pulses in which the maximum overlapped level of the previously stored invert timing is relatively low are set as driving pulses to be actually applied. In this manner, printing can be performed with image defects caused by an intense induction noise suppressed.

Second Embodiment

In the first embodiment, as described above, the processing of tentatively determining a driving pulse is performed such that a driving pulse corresponding to the ink temperature is selected according to the predetermined driving pulse table in which a plurality of driving pulses is specified.

In contrast, in the embodiment described below, the processing of tentatively determining a driving pulse is performed such that a reference driving pulse corresponding to the ink temperature is selected, and then pulse widths of the reference driving pulse is modulated according to conditions.

The description on the portion similar to the first embodiment will be omitted.

Figure 12:
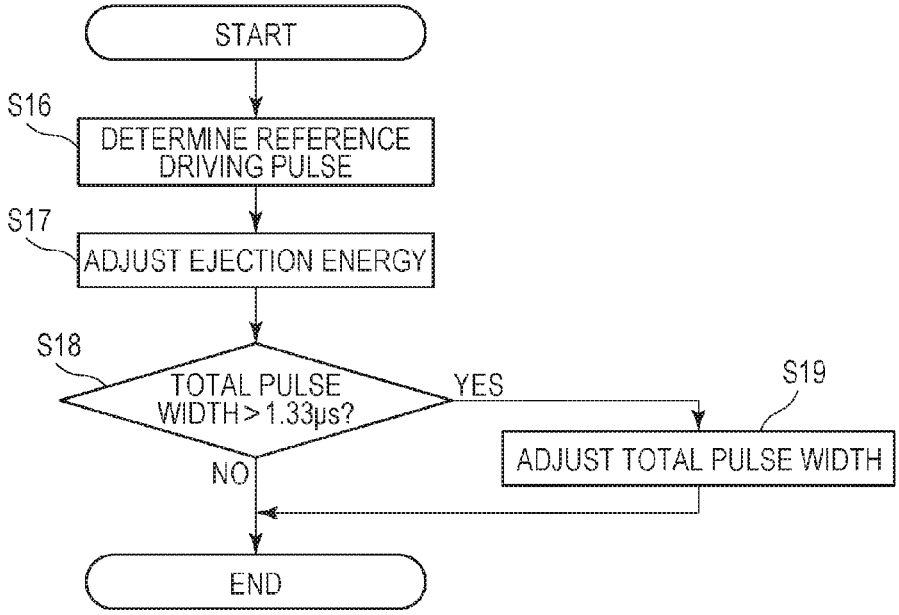
FIG. 12 is a figure for explaining the driving pulse control of the embodiment.

FIG. 12 is a flow chart illustrating a processing procedure of tentatively determining a driving pulse in the embodiment.

When the processing of tentatively determining a driving pulse starts in Step S10 illustrated in FIG. 10, the reference driving pulse for each printing element array is determined in Step S16. In the embodiment, a typical driving pulse control described using FIGS. 7A and 7B is performed as the processing of determining the reference driving pulse. For example, when the representative temperature of the printing element array 15$x$ is 25° C., No. 5 driving pulse illustrated in FIG. 7A is determined as the reference driving pulse for the printing element array 15$x$. When the representative temperature of the printing element array 17$x$ is 65° C., No. 1 driving pulse illustrated in FIG. 7A is determined as the reference driving pulse for the printing element array 17$x$.

Then, the processing of adjusting ink ejection energy is executed in Step S17. Specifically, the main pulse width P3 is modulated according to the representative temperature and the number of simultaneously driving. The modulation is performed such that the ink ejection energy is approximately constant even under conditions of different representative temperatures of printing element arrays and different numbers of simultaneous driving of printing elements in the printing element array during printing images. The processing of adjusting ejection energy may be executed independently among printing element arrays.

It is known that there is a maximum limit value for the sum of the pre-pulse width P1, the time interval P2, and the main pulse width P3 of the driving pulse (hereinafter also referred as the total pulse width of a driving pulse) that can be applied to the printing element. However, when the main pulse width P3 is modulated in the processing of adjusting ejection energy in Step S17, the total pulse width of the resulting driving pulse might exceed the upper limit value. Thus, in the embodiment, whether the total pulse width of the driving pulse resulting from the processing of adjusting ejection energy is equal to or greater than the upper limit value is determined (Step S18). The upper limit value of the total pulse width is specified according to a drive frequency and the number of time divisions, and is 1.33 μs in the embodiment.

If it is determined that the total pulse width of the driving pulse resulting from adjusting the ejection energy is not exceeding the upper limit value in Step S18, the driving pulse resulting from adjusting the ejection energy is tentatively determined as the driving pulse to be used in Step S11 onward in FIG. 10. When it is determined that the total pulse width of the driving pulse resulting from adjusting the ejection energy exceeds the upper limit value, the processing of adjusting the total pulse width is executed in Step S19.

Figure 13:
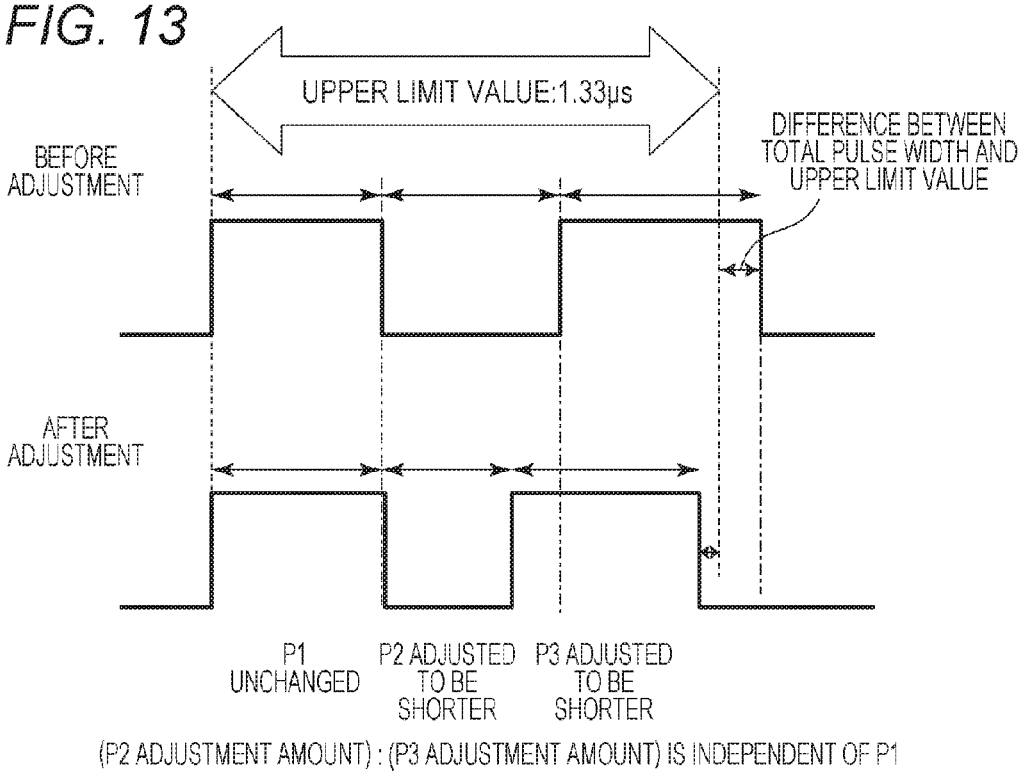
FIG. 13 is a figure for explaining the processing of modulating a total pulse width in the embodiment.

FIG. 13 is a schematic view for explaining the processing of adjusting the total pulse width in the embodiment.

In the embodiment, the pre-pulse width P1 is kept unchanged, when the total pulse width is greater than the upper limit value. This is because the pre-pulse width P1 largely affects the ink ejection volume. When the pre-pulse width P1 is changed, the printing quality might be deteriorated.

In contrast, changes in the time interval P2 and the main pulse width P3 have relatively low effect on the ink ejection volume. However, when only one of the time interval P2 and the main pulse width P3 is reduced, the ejection energy adjusted in Step S17 might be changed. Therefore, in the embodiment, if the total pulse width is greater than the upper limit value, both the time interval P2 and the main pulse width P3 are reduced according to the difference (difference value) between the total pulse width and the upper limit value.

In the processing of adjusting the total pulse width in the embodiment, taking aforementioned discussions in consideration, the total pulse width is adjusted using the table specifying correction amounts of the time interval P2 and the main pulse width P3 associated with the difference between the total pulse width and the upper limit value.

FIG. 14 is a figure illustrating the table, used in the embodiment, that specifies correction amounts of the time interval P2 and the main pulse width P3 associated with the difference x between the total pulse width and the upper limit value. The table illustrated in FIG. 14 specifies the correction amounts in such a manner that the ink ejection energy is approximately constant after adjusting the time interval P2 and the main pulse width P3. Specifically, the table is given such that the ratio of the correction amount of the main pulse width P3 to the correction amount of the time interval P2 is approximately constant under any value of the difference x between the total pulse width and the upper limit value. For example, the ratio of the main pulse width P3 to the time interval P2 is 0.002:0.022=1:11 when the difference x is within a range of $0.016<x\leq0.024$, whereas the ratio of the main pulse width P3 to the time interval P2 is 0.008:0.080=1:10 when the difference x is within a range of $0.080<x\leq0.088$. In the embodiment, by using the table specifying the correction amounts such that the ratio of the correction amount of the main pulse width P3 to the correction amount of the time interval P2 is always approximately 1:10 as described above, the ejection energy is kept approximately constant even after adjusting the total pulse width.

For example, when the pre-pulse width P1 is 0.40 μs, the time interval P2 is 0.30 μs, and the main pulse width P3 is 0.70 μs in the driving pulse resulting from the processing of adjusting the ejection energy in Step S17, the total pulse width is 1.40 (=0.40+0.30+0.70). In this case, the difference x between the total pulse width and the upper limit value is 0.07 (1.40−1.33). Thus, according to the table illustrated in FIG. 14, the correction amounts are determined such that the time interval P2 is reduced by 0.065 μs and the main pulse width P3 is reduced by 0.007 μs. Therefore, the driving pulse resulting from the processing of adjusting the total pulse width executed in Step S19 has the pre-pulse width P1 of 0.40 μs, the time interval P2 of 0.235 (=0.30−0.065) μs, and the main pulse width P3 of 0.693 (=0.70−0.007) μs.

As described above, if it is determined that the total pulse width is greater than the upper limit value in Step S18, the total pulse width is adjusted in Step S19 and the resulting driving pulse is tentatively determined as the driving pulse to be used in Step S11 onward in FIG. 10.

According to the embodiment as described above, an image defect caused by an induction noise can be suppressed and, in addition, the ejection energy and the total pulse width can suitable be adjusted.

Although the correction amount is determined using the table illustrated in FIG. 14 in the embodiment, the correction amount can be determined by other methods. The correction amount may be determined by processing as long as the total pulse width can be adjusted in a manner that the ink ejection energy is unchanged after adjustment and the total pulse width is equal to or lower than the upper limit value after adjustment. For example, when the ejection energy can be kept approximately constant under a condition where the ratio of the correction amount of the main pulse width P3 to the correction amount of the time interval P2 is always approximately 1:10, the correction amount of the main pulse width P3 and the correction amount of the time interval P2 may be determined according to Equation 1 and Equation 2 listed below.

$$P2 \text{ correction amount} = -(\text{difference} \times \text{between total pulse width and upper limit value}) \times 10/11 \quad \text{Equation 1}$$

$$P3 \text{ correction amount} = -(\text{difference} \times \text{between total pulse width and upper limit value})/11 \quad \text{Equation 2}$$

Under a condition specified by Equation 1 and Equation 2, the ratio of P3 correction amount to P2 correction amount is 1:10 for any value of the difference x between the total pulse width and the upper limit value, so that the ejection energy can be kept approximately unchanged before and after adjustment. Moreover, since the absolute value of the sum of P3 correction amount and P2 correction amount is identical to the difference x between the total pulse width and the upper limit value, the total pulse width after the adjustment can be set equal to or smaller than the upper limit value.

Although the pre-pulse width P1 is unchanged in the processing of adjusting the total pulse width in the embodiment, the pre-pulse width P1 may be adjusted in other embodiments in addition to the adjustment of the time interval P2 and the main pulse width P3.

Third Embodiment

In the first and second embodiments, the driving pulse previously stored in the ROM 102 is used when the maximum overlapped level of invert timing is higher than a predetermined threshold.

In the embodiment, in contrast, when the maximum overlapped level of invert timing is higher than a predetermined threshold and the driving pulse that has been tentatively determined at a preceding timing is set as a driving pulse to be actually applied, the actually applied driving pulse is used again.

The description on the portion similar to the first and second embodiments will be omitted.

Figure 15:
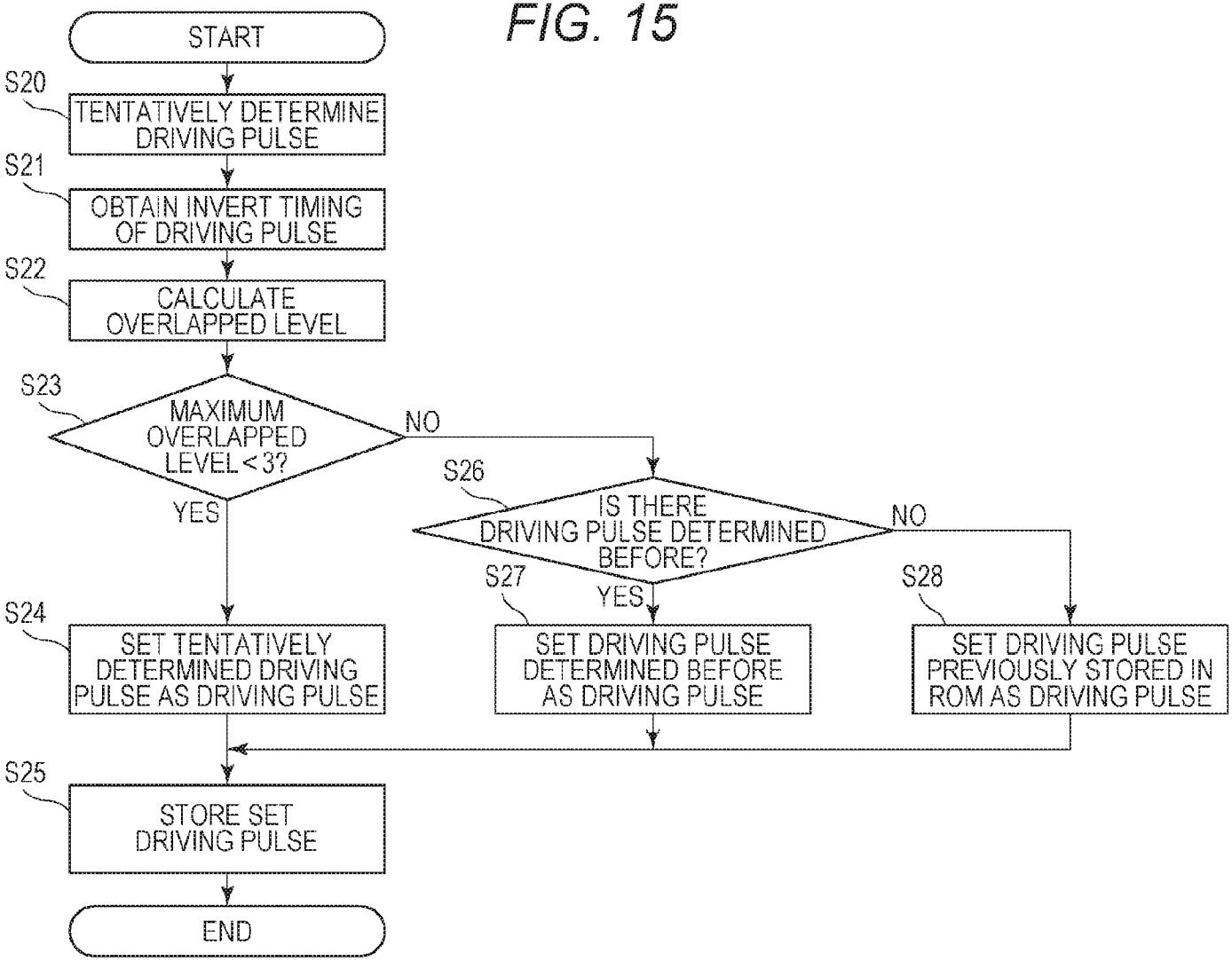
FIG. 15 is a figure for explaining the driving pulse control of the embodiment.

FIG. 15 is a flow chart for explaining the driving pulse control of the embodiment.

For the embodiment also, the driving pulse control illustrated in FIG. 15 is performed every 5 ms during printing an image. The time interval of performing the driving pulse control is not limited to 5 ms and can suitably be set to different time interval.

The process from Steps S20 to S24 in FIG. 15 is similar to the process from Steps S10 to S14 in FIG. 10.

If the maximum overlapped level of invert timing is determined in Step S23 to be lower than a predetermined threshold and the tentatively determined driving pulse is determined in Step S24 as the driving pulse to be actually applied, the determined driving pulse is stored in the RAM 103 in Step S25. If a driving pulse has already been stored in the RAM 103 in the preceding driving pulse control, the stored driving pulse is updated with driving pulse which is newly set in Step S25.

If the maximum overlapped level of invert timing is determined to be higher than the predetermined threshold in Step S23, whether a driving pulse has been stored in the RAM 103 in the driving pulse control performed at a preceding timing (point of time) is determined (Step S26). If it is determined that no driving pulse has been stored, processing similar to Step S15 in FIG. 10 is executed (Step S28).

If the driving pulse set before has been stored, the stored driving pulse is set again as the driving pulse to be actually applied (Step S27). Since the stored driving pulse is determined in a preceding driving pulse control that the maximum overlapped level of invert timing is lower than the predetermined threshold, an image defect caused by an induction noise is not likely to occur. Considering the time interval for performing the driving pulse control being 5 ms, the change in the printing head temperature is approximately several degrees of centigrade if the driving pulse has been stored at a timing relatively very close to the present timing. Therefore, the deviation from the driving pulse set by a correct ejection amount control can be minimized.

According to the embodiment as described above, the driving pulse control that can avoid an image defect caused by an induction noise and minimize unevenness of density caused by fluctuation in ejection amount can be realized.

Fourth Embodiment

In the first to third embodiments described above, the number of invert timings of driving pulses overlapped at a timing is defined as the overlapped level of invert timing.

In the embodiment, the number of invert timings of driving pulses included in a predetermined period is defined as an overlapped level of invert timing.

The description on the portion similar to the first to third embodiments described above will be omitted.

It is known that in an actual system, an induction noise occurs not only when invert timings are overlapped at a timing but when invert timings are chronologically close to each other. Therefore, in the embodiment, the number of invert timings of driving pulses that are included in a predetermined time range is defined as the overlapped level. The predetermined time range in the embodiment is 0.03 μs. The predetermined time range can suitably be changed, preferably 0.1 μs or smaller. The predetermined time range is preferably smaller than any of the pre-pulse width P1, the time interval P2, and the main pulse width P3.

FIG. 16 is a figure for explaining a method of calculating the overlapped level of invert timing of driving pulses. In FIG. 16, an example of driving pulses applied to four printing element arrays 15*x* to 18*x* provided on the printing element substrate 10*b* is illustrated.

As illustrated in FIG. 16, for the driving pulse applied to the printing element array 15*x*, the offset P0 to the leading edge of the pre-pulse is 0.2 μs, the pre-pulse width P1 is 0.3 μs, the time interval P2 is 0.4 μs, and the main pulse width P3 is 0.75 μs. Therefore, the invert timing PT0 is 0.2 μs, the invert timing PT1 is 0.5 μs, the invert timing PT2 is 0.9 μs, and the invert timing PT3 is 1.65 μs.

For the driving pulse applied to the printing element array 16*x*, the offset P0 to the leading edge of the pre-pulse is 0.25 μs, the pre-pulse width P1 is 0.3 μs, the time interval P2 is 0.4 μs, and the main pulse width P3 is 0.69 μs. Therefore, the invert timing PT0 is 0.25 μs, the invert timing PT1 is 0.55 μs, the invert timing PT2 is 0.95 μs, and the invert timing PT3 is 1.64 μs.

For the driving pulse applied to the printing element array 17*x*, the offset P0 to the leading edge of the pre-pulse is 0.3 μs, the pre-pulse width P1 is 0.3 μs, the time interval P2 is 0.4 μs, and the main pulse width P3 is 0.67 μs. Therefore, the invert timing PT0 is 0.3 μs, the invert timing PT1 is 0.6 μs, the invert timing PT2 is 1.0 μs, and the invert timing PT3 is 1.67 μs.

For the driving pulse applied to the printing element array 18*x*, the offset P0 to the leading edge of the pre-pulse is 0.35 μs, the pre-pulse width P1 is 0.3 μs, the time interval P2 is 0.4 μs, and the main pulse width P3 is 0.7 μs. Therefore, the invert timing PT0 is 0.35 μs, the invert timing PT1 is 0.65 μs, the invert timing PT2 is 1.05 μs, and the invert timing PT3 is 1.75 μs.

In the embodiment as described above, the number of invert timings of driving pulses, among four invert timings PT0, PT1, PT2, and PT3 of driving pulses illustrated in FIG. 16, that are included within a time range of 0.03 μs is defined as the overlapped level of invert timing at the timing of the time range. Then the maximum overlapped level of invert timing, among all the timings, is calculated. When the maximum overlapped level is equal to or higher than 3, which is the predetermined threshold, the driving pulse to be actually applied is changed.

Regarding the driving pulses illustrated in FIG. 16, for example, the invert timing PT3 of the driving pulse applied to the printing element array 15$x$, the invert timing PT3 of the driving pulse applied to the printing element array 16$x$, and the invert timing PT3 of the driving pulse applied to the printing element array 17$x$ are included in the 0.03 μs time range from the timing of 1.64 μs to the timing of 1.67 μs. Therefore, the overlapped level of invert timing of the driving pulses illustrated in FIG. 16 for the 0.03 μs time range from the timing of 1.64 μs to the timing of 1.67 μs is 3.

There is no other invert timing included in a time range of 0.03 μs. Thus, the maximum overlapped level of invert timing is calculated to be 3. So that, when the driving pulses illustrated in FIG. 16 are to be actually applied to the printing element arrays 15$x$ to 18$x$, an intense induction noise might occur, so the driving pulses to be applied are changed.

According to the embodiment as described above, a more realistic situation, such as invert timings of driving pulses being included in a specific time range instead of being overlapped at a timing, that causes an induction noise can be estimated.

Although the driving pulse to be actually applied is changed when the maximum overlapped level of invert timing is equal to or higher than the predetermined threshold of 3 in the embodiments described above, the driving pulse to be applied can be determined by other methods. For example, the intensity of induction noise generally increases as the number of simultaneously driven printing elements on the printing element substrate increases. Therefore, the predetermined threshold may be set to 3 when the number of simultaneous ejections on the printing element substrate is equal to or smaller than a predetermined number, and set to 2 when the number of simultaneous ejections is larger than the predetermined number. In this manner, in a state of relatively large number of simultaneous ejections where an intense induction noise is likely to occur, the driving pulses to be actually applied can readily be changed to driving pulses having invert timings not being overlapped.

Although the maximum value is used as the value representing the overlapped level (overlapping value) of invert timings PT0, PT1, PT2, and PT3 in the embodiments described above, other representative values may be used. For example, the average value or the minimum value, instead of the maximum value, of invert timings PT0, PT1, PT2, and PT3 may be used as overlapped level. Not all four invert timings PT0, PT1, PT2, and PT3 should be used. For example, when an induction noise is very likely to occur at the timing of the leading edge rather than the trailing edge of the driving pulse, only the invert timings PT0 and PT2 may be used. Alternatively, when an induction noise is very likely to occur at the timing of an invert timing of the main pulse rather than an invert timing of the pre-pulse, only the invert timings PT2 and PT3 may be used.

Although the driving pulse to be applied is changed to the driving pulse previously stored in the ROM 102 when the maximum overlapped level of invert timing is equal to or higher than a predetermined threshold in the embodiments described above, the driving pulse may be changed according to other conditions. For example, the ROM 102 may store four first driving pulses having the pre-pulse width of 0.30 μs and different invert timings shifted from each other as illustrated in FIG. 11 and four second driving pulses having the pre-pulse width of 0.50 μs and different invert timings shifted from each other, and driving pulses may be changed to the four first driving pulses when the printing head temperature is relatively high and to the four second driving pulses when the printing head temperature is relatively low. Alternatively, when the maximum overlapped level of invert timing of driving pulses is equal to or higher than a predetermined threshold, the pulse widths of the driving pulses may be modulated such that the invert timings of the pulse widths are not overlapped.

Although the printing head including a plurality of printing element arrays arranged along X direction is used and an applied driving pulse is determined for each printing element array in the embodiments described above, driving pulses may be determined by other methods. For example, a driving pulse to be applied may be determined for each of the group of printing elements in the upstream Y direction and for the group of printing elements in the downstream Y direction in the same printing element array.

By using the ink jet printing apparatus and the ink jet printing method according to the embodiment of the present invention, an image defect caused by an intense induction noise can be suppressed.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-048574, filed Mar. 11, 2015, which is hereby incorporated by reference herein in its entirety.

What is claimed is:

1. An ink jet printing apparatus for performing printing by using a print head that includes a substrate and a plurality of printing element arrays provided on the substrate and that ejects ink according to transmitted data, each of the plurality of printing element arrays having a plurality of printing elements which generates energy for ejecting ink by applying a driving pulse, the driving pulse comprising a pre-pulse which is applied in a period from a first timing to a second timing, and a main pulse which is applied in a period from a third timing which is later than the first timing to a fourth timing, the ink jet printing apparatus comprising:

a first determination unit configured to determine a plurality of first driving pulses corresponding to the plurality of printing element arrays;

an obtaining unit configured to obtain an overlapping value indicating the number of overlapped timings among the first, second, third, and fourth timings of the plurality of first driving pulses;

a second determination unit configured to determine a plurality of second driving pulses to be applied to the plurality of printing element arrays according to the overlapping value;

a control unit configured to control ejecting ink from the plurality of printing element arrays based on the plurality of second driving pulses, wherein the second determination unit determines the plurality of first driving pulses as the plurality of second driving pulses when the overlapping value is smaller than a predetermined threshold, and determines a plurality of third driving pulses as the plurality of second driving pulses when the overlapping value is larger than the predetermined threshold, wherein the plurality of third driving pulses is different from the plurality of first driving pulses, and the overlapping value corresponding to the number of overlapped timings among the first, second, third, and fourth timings of the plurality of third driving pulses is smaller than the predetermined threshold.

2. The ink jet printing apparatus according to claim 1, wherein the obtaining unit obtains a maximum number of overlapped timings as the overlapping value.

3. The ink jet printing apparatus according to claim 1, wherein the first determination unit determines the plurality of first driving pulses at a predetermined time interval, the obtaining unit obtains the overlapping value at the predetermined time interval, and the second determination unit determines the plurality of second driving pulses at the predetermined time interval.

4. The ink jet printing apparatus according to claim 3, further comprising a storing unit configured to store the plurality of second driving pulses determined at the predetermined time interval by the second determination unit, wherein the second determination unit, when the overlapping value obtained at a first point of time is larger than the predetermined threshold, determines the plurality of second driving pulses that is stored in the storing unit at a second point of time earlier than the first point of time as the plurality of second driving pulses at the first point of time.

5. The ink jet printing apparatus according to claim 4, wherein the second point of time is earlier than the first point of time by the predetermined time interval.

6. The ink jet printing apparatus according to claim 1, further comprising a storing unit configured to store the plurality of third driving pulses that are previously determined, wherein a maximum number of overlapped timings among the first, second, third, and fourth timings of the plurality of third driving pulses is smaller than the predetermined threshold.

7. The ink jet printing apparatus according to claim 6, wherein none of the first, second, third, and fourth timings of the plurality of third driving pulses is overlapped.

8. The ink jet printing apparatus according to claim 1, further comprising a second obtaining unit configured to obtain information regarding ink temperature of each of the plurality of printing element arrays, wherein the first determination unit determines the plurality of first driving pulses for each of the plurality of printing element arrays based on temperature indicated by the information.

9. The ink jet printing apparatus according to claim 8, wherein the first determination unit includes a selecting unit configured to select one of the plurality of driving pulses for each of the plurality of printing element arrays based on temperature indicated by the information obtained by the second obtaining unit, a first adjusting unit configured to adjust the driving pulse selected by the selecting unit for each of the plurality of printing element arrays, and a second adjusting unit configured to determine the plurality of first driving pulses for each of the plurality of printing element arrays, when a time interval between the first timing and the fourth timing of the driving pulse resulting from adjustment made by the first adjusting unit is longer than a predetermined time interval, by further adjusting the driving pulse resulting from adjustment made by the first adjusting unit such that the time interval between the first timing and the fourth timing is shorter than the predetermined time interval.

10. The ink jet printing apparatus according to claim 9, wherein the selecting unit, for one of the plurality of printing element arrays, selects the driving pulse in which a time interval between the first timing and the second timing is a first interval, when temperature indicated by the information obtained by the second obtaining unit is a first temperature, and selects the driving pulse in which the time interval between the first timing and the second timing is a second interval shorter than the first interval, when temperature indicated by the information obtained by the second obtaining unit is a second temperature higher than the first temperature.

11. The ink jet printing apparatus according to claim 9, wherein the first adjusting unit adjusts the driving pulse selected by the selecting unit based on temperature indicated by the information obtained by the second obtaining unit.

12. The ink jet printing apparatus according to claim 9, wherein the second adjusting unit performs no adjustment of the driving pulse resulting from adjustment made by the first adjusting unit, when the time interval between the first timing and the fourth timing of the driving pulse resulting from adjustment made by the first adjusting unit is shorter than the predetermined time interval for one of the plurality of printing element arrays.

13. The ink jet printing apparatus according to claim 9, wherein the second adjusting unit, for one of the plurality of printing element arrays, further adjusts the driving pulse resulting from adjustment made by the first adjusting unit such that a time interval between the third timing and the fourth timing is shorter by a first correction amount, when the time interval between the first timing and the fourth timing of the driving pulse resulting from adjustment made by the first adjusting unit is longer than the predetermined time interval and a difference between the time interval between the first timing and the fourth timing of the driving pulse resulting from adjustment made by the first adjusting unit and the predetermined time interval is a first difference value, and further adjusts the driving pulse resulting from adjustment made by the first adjusting unit such that a time interval between the third timing and the fourth timing is shorter by a second correction amount larger than the first correction amount, when the time interval between the first timing and the fourth timing of the driving pulse resulting from adjustment made by the first adjusting unit is longer than the predetermined time interval and the difference between the time interval between the first timing and the fourth timing of the driving pulse resulting from adjustment made by the first adjusting unit and the predetermined time interval is a second difference value larger than the first difference value.

14. The ink jet printing apparatus according to claim 13, wherein the second adjusting unit, for one of the plurality of printing element arrays, further adjusts the driving pulse resulting from adjustment made by the first adjusting unit such that a time interval between the second timing and the third timing is shorter by a third correction amount, when the time interval between the first timing and the fourth timing of the driving pulse resulting from adjustment made by the first adjusting unit is longer than the predetermined time interval and the difference between the time interval between the first timing and the fourth timing of the driving pulse resulting from adjustment made by the first adjusting unit and the predetermined time interval is the first difference value, and further adjusts the driving pulse resulting from adjustment made by the first adjusting unit such that a time interval between the second timing and the third timing is shorter by a fourth correction amount larger than the third correction amount, when a time interval between the first timing and the fourth timing of the driving pulse resulting from adjustment made by the first adjusting unit is longer than the predetermined time interval and the difference between the time interval between the first timing and the fourth timing of the driving pulse resulting from adjustment made by the first adjusting unit and the predetermined time interval is the second difference value.

15. The ink jet printing apparatus according to claim 14, wherein a ratio of the first correction amount to the third correction amount is approximately equal to a ratio of the second correction amount to the fourth correction amount.

16. The ink jet printing apparatus according to claim 13, wherein the second adjusting unit further adjusts the driving pulse resulting from adjustment made by the first adjusting unit so as to keep a time interval between the first timing and the second timing unchanged, when a time interval between the first timing and the fourth timing of the driving pulse resulting from adjustment made by the first adjusting unit is longer than the predetermined time interval for one of the plurality of printing element arrays.

17. The ink jet printing apparatus according to claim 1, further comprising:

a third obtaining unit configured to obtain information regarding the number of simultaneously driven printing elements among the plurality of printing elements arranged on the plurality of printing element arrays; and a setting unit configured to set a first threshold as the predetermined threshold, when the number of printing elements indicated by the information obtained by the third obtaining unit is a first number, and set a second threshold smaller than the first threshold as the predetermined threshold, when the number of printing elements indicated by the information obtained by the third obtaining unit is a second number larger than the first number.

18. The ink jet printing apparatus according to claim 1, wherein the plurality of printing element arrays ejects ink of different colors.

* * * * *